US005489974A

United States Patent [19]

Kamaji et al.

[11] Patent Number: 5,489,974

[45] Date of Patent: Feb. 6, 1996

[54] IMAGE FORMATION APPARATUS, DEVELOPING DEVICE INCORPORATED THEREIN AND CONDUCTIVE RUBBER ROLLER USED THEREIN

[75] Inventors: Hideki Kamaji; Kazumi Kawabata; Kazunori Hirose; Sadaaki Yoshida; Takeshi Tanimoto, all of Kawasaki, Japan

[73] Assignee: Fujitsu Limited, Kawasaki, Japan

[21] Appl. No.: 445,732

[22] Filed: May 22, 1995

Related U.S. Application Data

[63] Continuation of Ser. No. 102,965, Aug. 6, 1993, abandoned.

[30] Foreign Application Priority Data

Sep. 28, 1992 [JP] Japan ..... 4-257915
Sep. 28, 1992 [JP] Japan ..... 4-257917
Sep. 28, 1992 [JP] Japan ..... 4-257918

[51] Int. Cl.[6] ..... G03G 15/06

[52] U.S. Cl. ..... 355/245; 355/259; 355/274

[58] Field of Search ..... 355/245, 251, 355/259, 271, 274, 277, 219; 118/653, 661; 430/105, 107, 109, 110, 137

[56] References Cited

U.S. PATENT DOCUMENTS 5,057,871 10/1991 Hirose et al. ..... 118/653 X
5,068,691 11/1991 Nishio et al. ..... 118/653 X
5,076,201 12/1991 Nishio et al. ..... 118/653
5,084,733 1/1992 Katoh et al. ..... 355/251
5,097,294 3/1992 Nishio et al. ..... 355/245
5,149,914 9/1992 Koga et al. ..... 355/251 X
5,164,773 11/1992 Nishio et al. ..... 355/245
5,220,129 6/1993 Nishio et al. ..... 355/251 X
5,255,057 10/1993 Stelter et al. ..... 118/653 X

*Primary Examiner*—Sandra L. Brasé
*Attorney, Agent, or Firm*—Staas & Halsey

[57] ABSTRACT

An electrostatic latent image formed on a photosensitive drum is electrostatically developed with a non-magnetic type developer, and is electrostatically transferred from the drum to a paper. The developer is composed of a toner component and a resin powder component, one component of which has a polarity opposite to that of an electric charge of the other component generated by triboelectrification therebetween. In the developing process, a conductive foam rubber developing roller is used, which includes a conductive tubular foam rubber roller element, and a metal shaft inserted into a central bore thereof. The roller element has an outer thicker portion including a conductive filler dispersed therein, and an inner solid skin layer defining the central bore thereof and exhibiting an electrical resistivity considerably higher than that of the thicker portion for lack of conductive filler. Nevertheless, a sufficient electrical contact is established between the roller element and the shaft. A thin metal blade is pressed against the roller for regulating the thickness of the developer entrained thereby, and is arranged to compensate for a resilient deformation of the shaft caused when pressing the blade against the roller.

52 Claims, 28 Drawing Sheets

IMAGE FORMATION APPARATUS, DEVELOPING DEVICE INCORPORATED THEREIN AND CONDUCTIVE RUBBER ROLLER USED THEREIN

This application is a continuation, of application Ser. No. 08/102,965, filed Aug. 6, 1993, now abandoned.

BACKGROUND OF THE INVENTION

1) Field of the Invention

The present invention generally relates to an image formation apparatus wherein an electrostatic latent image formed on an image carrying body such as a photosensitive body, a dielectric body or the like is electrostatically developed with a developer or toner, and the developed image is transferred from the image carrying body to a recording medium such as a sheet of paper.

Also, the present invention is directed to a developing device forming a part of such an image formation apparatus, and further to a conductive rubber roller used in the developing process and/or the transferring process in the image formation apparatus.

2) Description of the Related Art

As a representative of the image formation apparatus as mentioned above, an electrophotographic recording apparatus is well known, wherein the following processes are typically carried out:

a) a uniform distribution of electrical charges is produced on a surface of an electrostatic latent image carrying body;

b) an electrostatic latent image is formed on a charged area of the body surface by an optical writing means such as a laser beam scanner, an LED (light emitting diode) array, a liquid crystal shutter array or the like;

c) the latent image is developed as a visible image with a developer or toner, which is electrically charged to be electrostatically adhered to the latent image zone;

d) the developed and charged toner image is electrostatically transferred from the body to a recording medium such as a sheet of paper; and e) the transferred toner image is fixed and recorded on the paper.

Typically, the electrostatic latent image carrying body may be an electrophotographic photoreceptor, usually formed as a drum, called a photosensitive drum, having a cylindrical conductive substrate formed of a metal such as aluminum, and a photoconductive insulating film bonded to a cylindrical surface thereof and formed of an organic photoconductor (OPC), a selenium photoconductor or the like.

As one type of developer used in the developing process, a non-magnetic developer is well known, and is composed of only a toner component, i.e., colored fine resin particles. A developing device using the non-magnetic type developer includes a vessel for holding the developer, and a conductive solid rubber roller provided within the vessel as a developing roller in such a manner that a portion of the solid rubber roller is exposed therefrom and is pressed against the photosensitive drum. When the conductive rubber roller is rotated within the vessel in which the developer is held, the toner component is frictionally entrained by the surface of the rubber roller to form a developer layer therearound, whereby the toner component can be brought to the photosensitive drum for the development of an electrostatic latent image formed thereon. The developing device further includes a blade member which is engaged with the surface of the developing roller to uniformly regulate a thickness of the developer layer formed therearound, so that an even development of the latent image can be carried out. The blade member also serves to electrically charge the toner component by a triboelectrification therebetween. In this developing device, the development Is carried out in such a manner that, at the contact area between the photosensitive drum and the rubber roller with the developer layer, the charged toner component is electrostatically attracted and adhered to the latent image due to a bias voltage applied to the rubber roller.

In the above-mentioned developing device for the non-magnetic type developer, the coefficient of surface friction of the rubber roller can be changed by environmental factors, especially, temperature and moisture content. If the friction coefficient of the rubber roller falls, a sufficient amount of the toner component, which is necessary for the development of the latent image, cannot be entrained by the rubber roller.

The Examined Japanese Utility Model Publication (Kokoku) No. 60-6946 discloses a solid rubber developing roller having a rough surface by which the toner particles can be sufficiently entrained though the friction coefficient of the roller becomes small. Nevertheless, when a coefficient of friction of the toner component becomes large due to a rise in temperature and moisture content, the toner component entrained by the rough surface of the rubber roller may be eliminated therefrom by the blade member for regulating the thickness of the developer layer formed on the developing roller, due to an increase of the frictional coefficient of the toner component.

U.S. Pat. No. 5,076,201 discloses a developing roller for the non-magnetic type developer, which is formed of a conductive open-cell foam rubber material so that pore openings appear on the surface of the developing roller. This open-cell foam rubber developing roller is softer than the solid rubber roller, and thus the toner component entrained by the rough surface of the rubber roller cannot be eliminated therefrom by the blade member for regulating the thickness of the developer layer formed on the developing roller, although the frictional coefficient of the toner component is increased due to the rise in temperature and moisture contents.

In the transferring process wherein the developed toner image is electrostatically transferred to a recording medium such as a sheet of paper, a conductive foam rubber roller is also used as an electric charging roller. The conductive foam rubber type charging roller is resiliently pressed against the photosensitive drum, and is connected to a suitable electric source so as to give the sheet of paper an electric charge having a polarity opposite to that of the developed toner image, whereby the developed toner image can be electrostatically transferred to the sheet of paper during a passage of the sheet of paper through a nip between the photosensitive drum and the charging roller.

It is preferable to use the conductive foam rubber roller as the developing roller and the charging roller, because these roller can have a suitable softness so that an operating life of the photosensitive drum can be extended as long as possible. Namely, the harder the developing and charging rollers resiliently pressed against the drum, the greater a wear of the photoconductive insulating film of the drum.

Conventionally, the conductive foam rubber roller may be produced by the following processes:

a) a suitable resin material, e.g., polyurethane, urethane, silicone, or the like, containing a conductive filler such as carbon black or a fine metal powder, and a water-soluble foam-providing substance such as polyvinyl alcohol or methyl cellulose is extruded as a long tubular product;

b) the extruded tubular product is immersed in a body of water held by a container, and thus the water-soluble foam-providing substance dissolves in the body of water so that a foam structure is given the tubular product;

c) the tubular foam product is cut into tubular roller elements having a predetermined length; and d) the tubular roller element is mounted and fixed on a metal shaft member by using a suitable adhesive such as a thermosetting adhesive, to thereby produce a conductive foam rubber roller.

This conductive foam rubber roller must be further treated before it can be used as a developing roller or a charging roller as mentioned above, because the tubular roller element is covered at an outer surface thereof by a solid skin layer having a thickness of about 1 to 5 μm and the content of the conductive filler is very small in comparison with that of the conductive filler in the internal foam structure of the tubular element. Namely, the conductive foam rubber roller is finished by removing the solid skin layer from the tubular roller element thereof.

Nevertheless, many of the finished conductive foam rubber rollers cannot have a desired electric characteristic when an electrical energy is applied to the tubular roller element through the metal shaft member, due to an existence of an inner solid skin layer formed at an inner wall surface of the central bore of the tubular roller element. In particular, an electric resistivity of the inner solid skin layer is considerably higher than that of the foam structure of the tubular roller element because a content of the conductive filler therein also is very small, and a thickness of the inner solid skin layer is variable along a longitudinal axis of the metal shaft member. Thus, an electric potential of the tubular roller element, which is obtained by the application of the electrical energy to the tubular roller element through the metal shaft member, is also variable along the longitudinal axis of the metal shaft member. Accordingly, for example, when this defective conductive foam rubber roller is used as a developing roller, it is impossible to obtain an even development of the latent image.

Also, U.S. Pat. No. 5,076,201 discloses that the pore opening of the conductive foam rubber developing roller should be at most twice an average diameter of the toner component to prevent a penetration of the toner component into the pore openings thereof. This conductive foam rubber developing roller cannot endure the recording operation in which the number of recorded sheets exceeds, for example, 30,000, because the pore openings thereof are completely blocked due to the penetration of the toner component. Accordingly, the conductive foam rubber developing roller must be frequently exchanged with a new one, for a proper development of an electrostatic latent image to be maintained.

Further, U.S. Pat. No. 5,076,201 further discloses that the blade member for uniformly regulating the thickness of the developer layer formed around the developing roller is formed of a conductive material such as metal, and is subjected to an application of electrical energy to electrically charge the toner component at a given polarity by a charge-injection effect during the regulation of the developer thickness. Nevertheless, a small part of the charged toner component may be reversely charged for the reason stated hereinafter in detail. Of course, the reversely-charged toner component results in a photographic fog.

On the other hand, there is a tendency toward a miniaturization of the image formation apparatus, especially when it is constructed as a personal use type. Accordingly, the developing device also must be miniaturized in proportion to the miniaturization of the image formation apparatus, so that the shaft member of the conductive foam rubber developing roller is obliged to be made slender. In this case, when the blade member is pressed against the developing roller at a given pressure for regulating a thickness of the developer entrained thereby, the slender shaft member of the developing roller is resiliently deformed or bent at a very small degree, so that the developing roller cannot be subjected to a uniform distribution of pressure by the blade member. Namely, a pressure exerted on a central zone of the developing roller is smaller than that exerted on the end zones thereof, and thus a regulation of the developer thickness cannot uniformalized by the blade member. Of course, the non-uniform developer layer results in uneven development of an electric latent image.

SUMMARY OF THE INVENTION

Therefore, an first object of the present invention is to provide an improved conductive foam rubber roller used in an image formation apparatus as mentioned above, which comprises a conductive tubular foam rubber roller element having a central bore defined by a solid skin layer having an electric resistivity considerably higher than that of a conductive foam structure of the conductive tubular foam rubber element, and a conductive shaft member on which the conductive foam rubber roller element is mounted and fixed, wherein the conductive foam rubber roller has a desired electric characteristic when an electrical energy is applied to the tubular roller element through the metal shaft member, regardless of an existence of a solid skin layer.

A second object of the present invention is to provide an improved developing device as mentioned above, which is constituted such that a whole of the toner component of the non-magnetic type developer can be surely charged at a given polarity by an charge-injection effect, whereby a proper development of an electrostatic latent image can be ensured.

A third object of the present-invention is to provide an improved developing device as mentioned above, having an conductive foam rubber developing roller, the service life of which is considerably extended.

A fourth object of the present invention is to provide an improved developing device as mentioned above, wherein a regulation of a thickness of a non-magnetic type developer entrained by a conductive foam rubber developing roller can be uniformalized as much as possible by a blade member pressed thereagainst.

In accordance with a first aspect of the present invention, there is provided to a conductive rubber roller used in an image formation apparatus wherein an electrostatic latent image formed on an image carrying body is electrostatically developed with a toner developer, and is electrostatically transferred from the image carrying body to a recording medium, which conductive rubber roller comprises: a conductive tubular rubber roller element having an outer thicker portion including a given amount of conductive filler dispersed therein, and an inner skin layer defining a central bore thereof and exhibiting an electric resistivity considerably higher than that of the outer thicker portion for lack of conductive filler; a conductive shaft member fixedly inserted into the central bore of the conductive tubular rubber roller element; and an electric contact establishing means provided between the conductive tubular rubber roller element and the conductive shaft member for establishing a sufficient electric contact therebetween, the electric contact establishing means including two conductive plate members mounted on the conductive shaft member and adhered to end faces of the conductive tubular rubber roller element by a conductive adhesive. The conductive plate members mounted on the conductive shaft member may be adhered to end faces of the conductive tubular rubber roller element by thermally fusing a material of the outer thicker portion of the conductive tubular rubber roller element at the end faces thereof. Also, the electric contact establishing means may comprise an at least partial thermal fusing of the inner skin layer of the conductive tubular rubber roller element, or may comprises an electrical insulation-breakage of the inner skin layer of the conductive tubular rubber roller element. Preferably, the outer thicker portion of the conductive tubular rubber roller element has an open-cell foam structure, and the inner skin layer is formed as a solid skin layer. The conductive rubber roller may be used in the image formation apparatus as a developing roller for entraining and carrying the toner developer to the image carrying body for development of an electrostatic latent image formed thereon. Also, the conductive rubber roller may be used in the image formation apparatus as a transferring roller for transferring a developed image from the image carrying body to a recording medium.

In accordance with a second aspect of the present invention, there is provided a developing device using a non-magnetic type developer for developing an electrostatic latent image formed on an image carrying body, which device comprises: a developer carrying means resiliently pressed against the image carrying body and formed of a conductive open-cell foam rubber material so that pore openings appear on a surface of the developer carrying means to entrain and carry the developer to a surface of the image carrying body for development of the electrostatic latent image formed thereon; and a developer regulating means engaged with the developer carrying means for regulating the thickness of the developer entrained and carried thereby, wherein the developer is composed of a toner component and a resin powder component, one component of which has a polarity opposite to that of an electric charge of the other component by triboelectrification therebetween. When the developer regulating means is formed of a conductive material such as metal, it is supplied with electrical energy to electrically charge the toner component of the developer at a given polarity by a charge-injection effect during the regulation of the thickness of the developer. Also, preferably, the pore openings of the developer carrying means have a diameter of from about two and a half to about four times an average diameter of the toner component of the developer. When the toner component of the developer is a polyester resin-based toner component, the resin powder component may be formed of a resin material selected from a group consisting of melamine resin, acrylic resin, and styrene acrylic resin. Preferably, the conductive open-cell foam rubber material of the developer carrying means has a volume resistivity of from about $10^4$ Ω.cm to about $10^{10}$ Ω.cm. The developer carrying means may comprise a developing roller means formed of a conductive open-cell foam rubber material selected from a group consisting of a conductive open-cell foam polyurethane rubber material, a conductive open-cell foam urethane rubber material, and a conductive open-cell foam silicone rubber material.

In accordance with the second aspect of the present invention, there is also provided an image formation apparatus comprising: an image carrying means for carrying an electrostatic latent image formed thereon; and a developing means for developing the electrostatic latent image of the image carrying means with a non-magnetic type developer, the developing means including a developer carrying means resiliently pressed against the image carrying means and formed of a conductive open-cell foam rubber material so that pore openings appear on a surface thereof to entrain and carry the developer to a surface of the image carrying means for development of the electrostatic latent image formed thereon, and a developer regulating means engaged with the developer carrying means for regulating a thickness of the developer entrained and carried thereby, wherein the developer is composed of a toner component and a resin powder component, one component of which has a polarity opposite to that of an electric charge of the other component by triboelectrification therebetween. The image formation apparatus may further comprise a transferring means for transferring a developed image from the image carrying means to a recording medium. When the developer regulating means is formed of a conductive material such as metal, it is supplied with electrical energy to electrically charge the toner component of the developer at a given polarity by a charge-injection effect during the regulation of the thickness of the developer. Preferably, the pore openings of the developer carrying means have a diameter of from about two times to about four times an average diameter of the toner component of the developer. When the toner component of the developer is a polyester resin-based toner component, the resin powder component may be formed of a resin material selected from a group consisting of melamine resin, acrylic resin, and styrene acrylic resin. Preferably, the conductive open-cell foam rubber material of the developer carrying means has a volume resistivity of from about $10^4$ Ω.cm to about $10^{10}$ Ω.cm. The developer carrying means may comprise a developing roller means formed of a conductive open-cell foam rubber material selected from a group consisting of a conductive open-cell foam polyurethane rubber material, a conductive open-cell foam urethane rubber material, and a conductive open-cell foam silicone rubber material.

In accordance with a third aspect of the present invention, there is provided a developing device using a non-magnetic type developer for developing an electrostatic latent image formed on an image carrying body, which device comprises: a developer carrying roller means resiliently pressed against the image carrying body and formed of a conductive open-cell foam rubber material so that pore openings appear on the surface of the developer carrying means to entrain and carry the developer to a surface of the image carrying body for development of the electrostatic latent image formed thereon; and a developer regulating means including a thin metal blade member pressed against the developer carrying roller means for regulating the thickness of the developer entrained and carried thereby, wherein the developer regulating means further includes a compensating means for compensating for a resilient deformation of a shaft member of the developer carrying roller means, which is caused when pressing the thin metal blade member against the developer carrying roller means, whereby the thickness of the developer regulated by the developer regulating means can be made substantially uniform. The compensating means may comprise a curvature of the thin metal blade member, which is defined such that the developer carrying roller means can be subjected to a uniform distribution of pressure by the thin metal blade member to make the thickness of the developer, regulated by the developer regulating means, uniform. The developer regulating means further includes a fitting plate member for rigidly supporting a part of the thin metal blade member. In this case, the compensating means may comprise a convex profile which is defined such that the developer carrying roller means can be subjected to a uniform distribution of pressure by the thin metal blade member. Also, the compensating means may comprise an application of an pressure to a center of the thin metal blade member, which is controlled such that the developer carrying roller means can be subjected to a uniform distribution of pressure by the thin metal blade member to make the thickness of the developer, regulated by the developer regulating means, uniform.

BRIEF DESCRIPTION OF THE DRAWINGS

Other objects and advantages of the present invention will be better understood from the following description, with reference to the accompanying drawings, in which.

DESCRIPTION OF THE PREFERRED EMBODIMENTS

Figure 1:
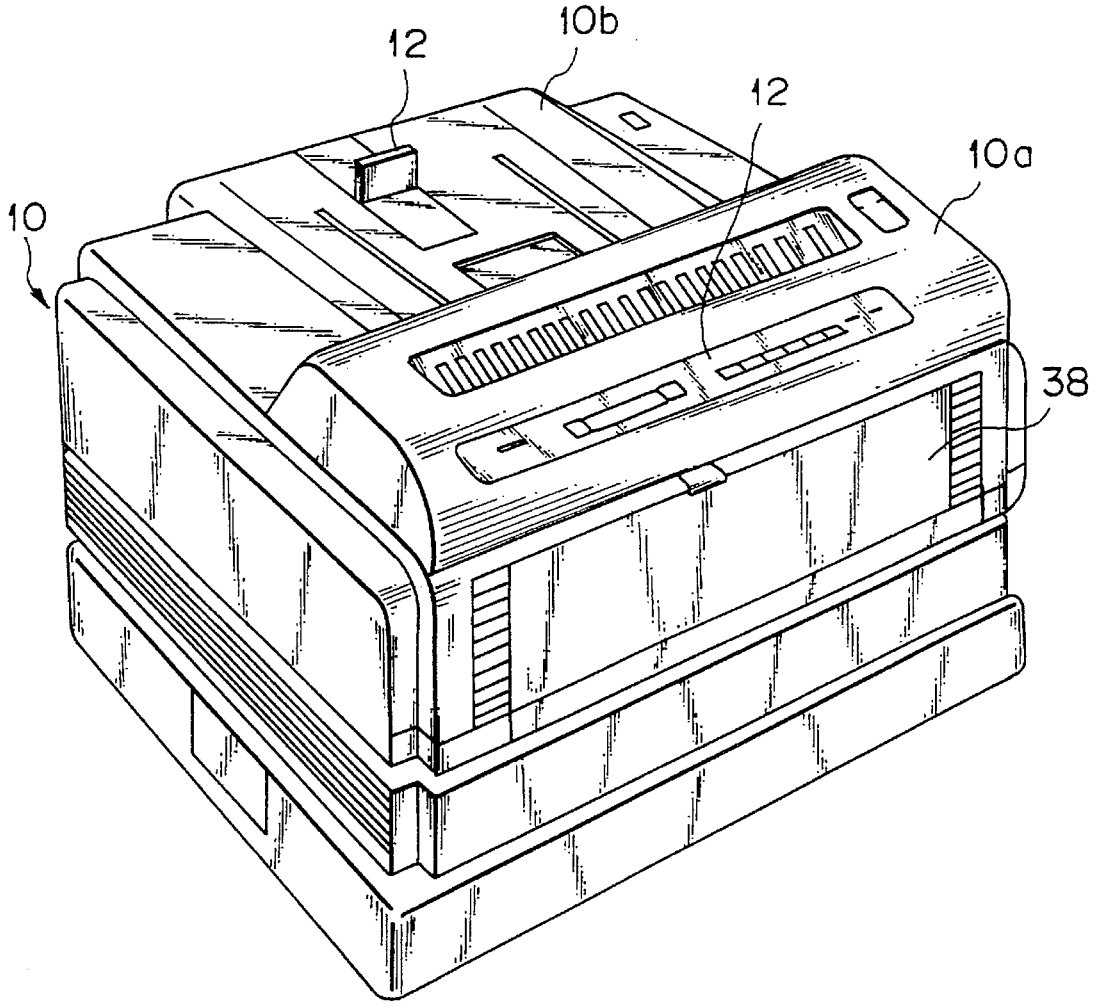
FIG. 1 is a perspective view of an electrophotographic laser printer in which the present invention is embodied.

FIGS. 1 shows an appearance of a laser printer as an example of an electrophotographic recording apparatus, in which the present invention is embodied. The printer comprises a printer housing 10 including a movable front cover 10*a* as a part thereof, and the front cover 10*a* can be moved from a closed position shown in FIG. 1 to an open position shown in FIG. 2. The printer housing 10 also includes a movable upper cover 10*b* as a part thereof, and the upper cover 10*b* can be moved from a closed position shown in FIG. 1 to an open position shown in FIG. 3. A top surface of the upper cover 10*b* serves as a paper receiver for a printed paper. To this end, the upper cover has a paper stopper 12 provided on the top surface thereof, and, when a printed paper is discharged from the printer, the leading edge of the printed paper is abutted against the paper stopper 12.

Figure 2:
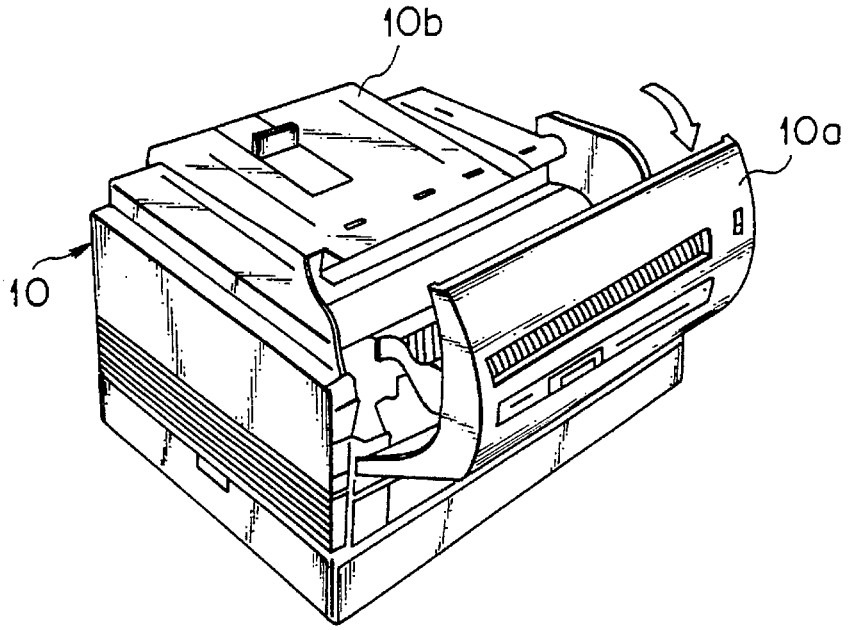
FIG. 2 is a perspective view of the laser printer shown in FIG. 1, in which a front cover is opened.
Figure 3:
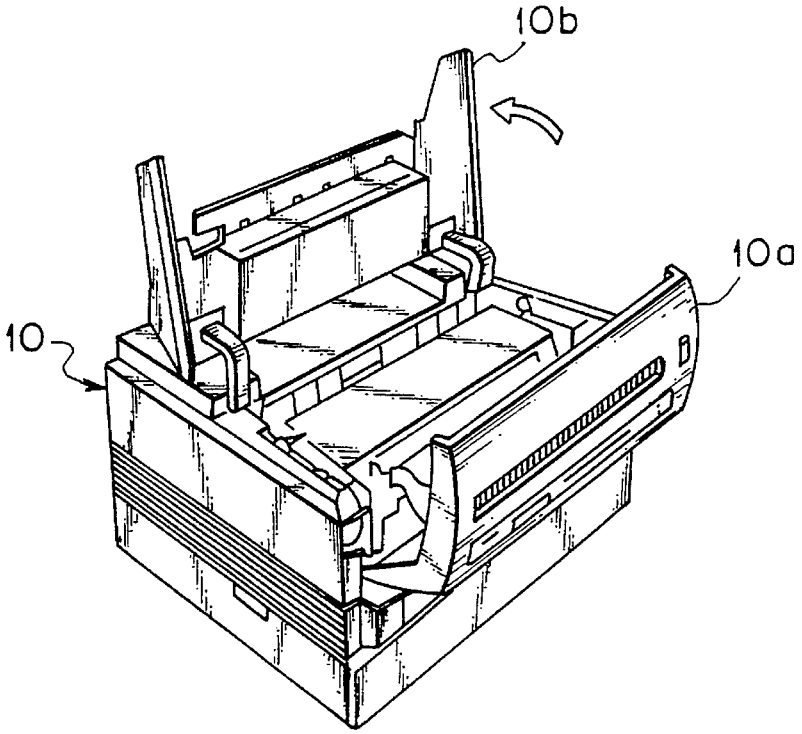
FIG. 3 is a perspective view of the laser printer shown in FIG. 1, in which an upper cover is further opened.
Figure 4:
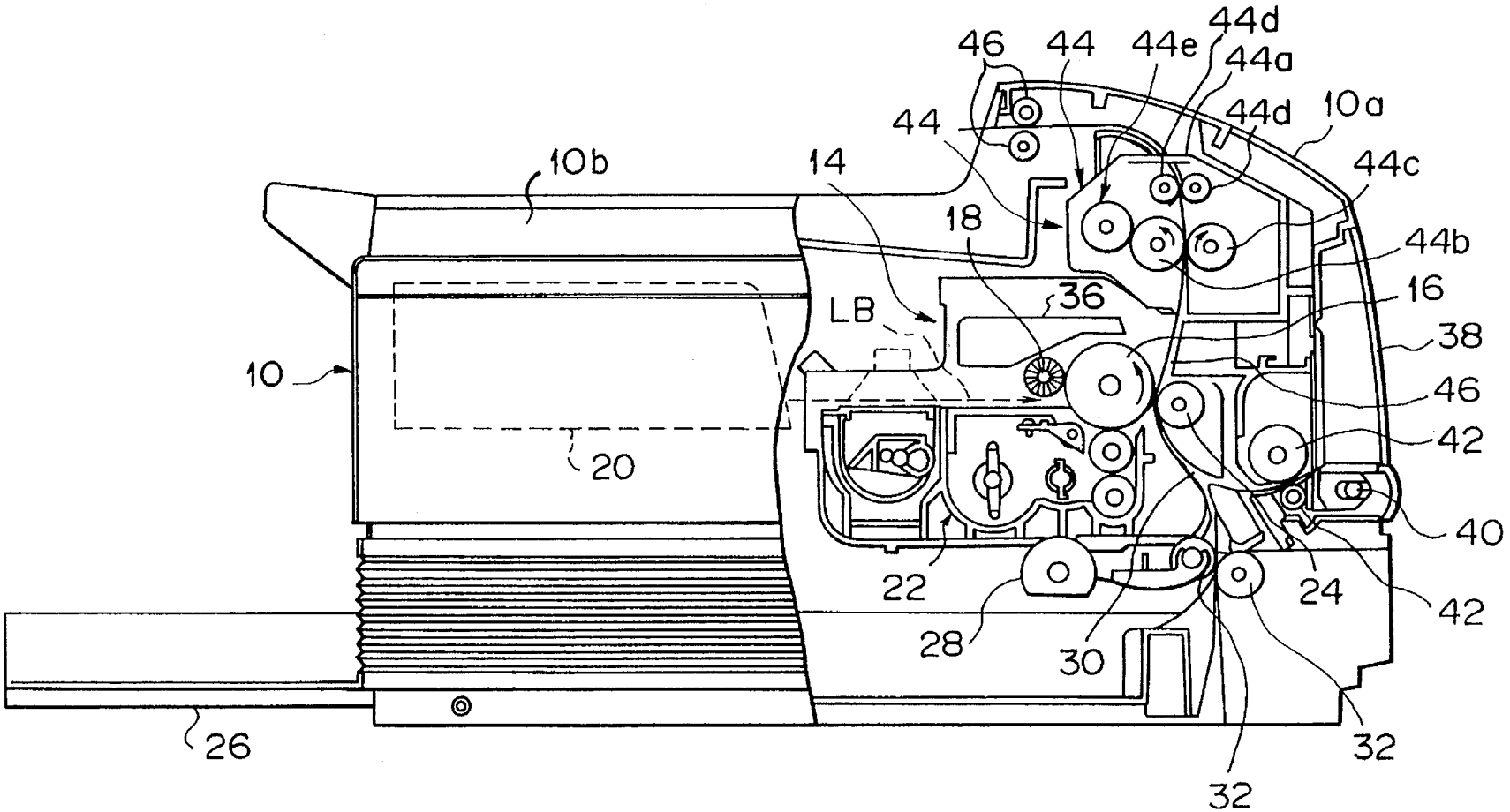
FIG. 4 is a partially cutaway side view of the laser printer as shown in FIG. 1, schematically illustrating a main part of an interior arrangement thereof.
Figure 5:
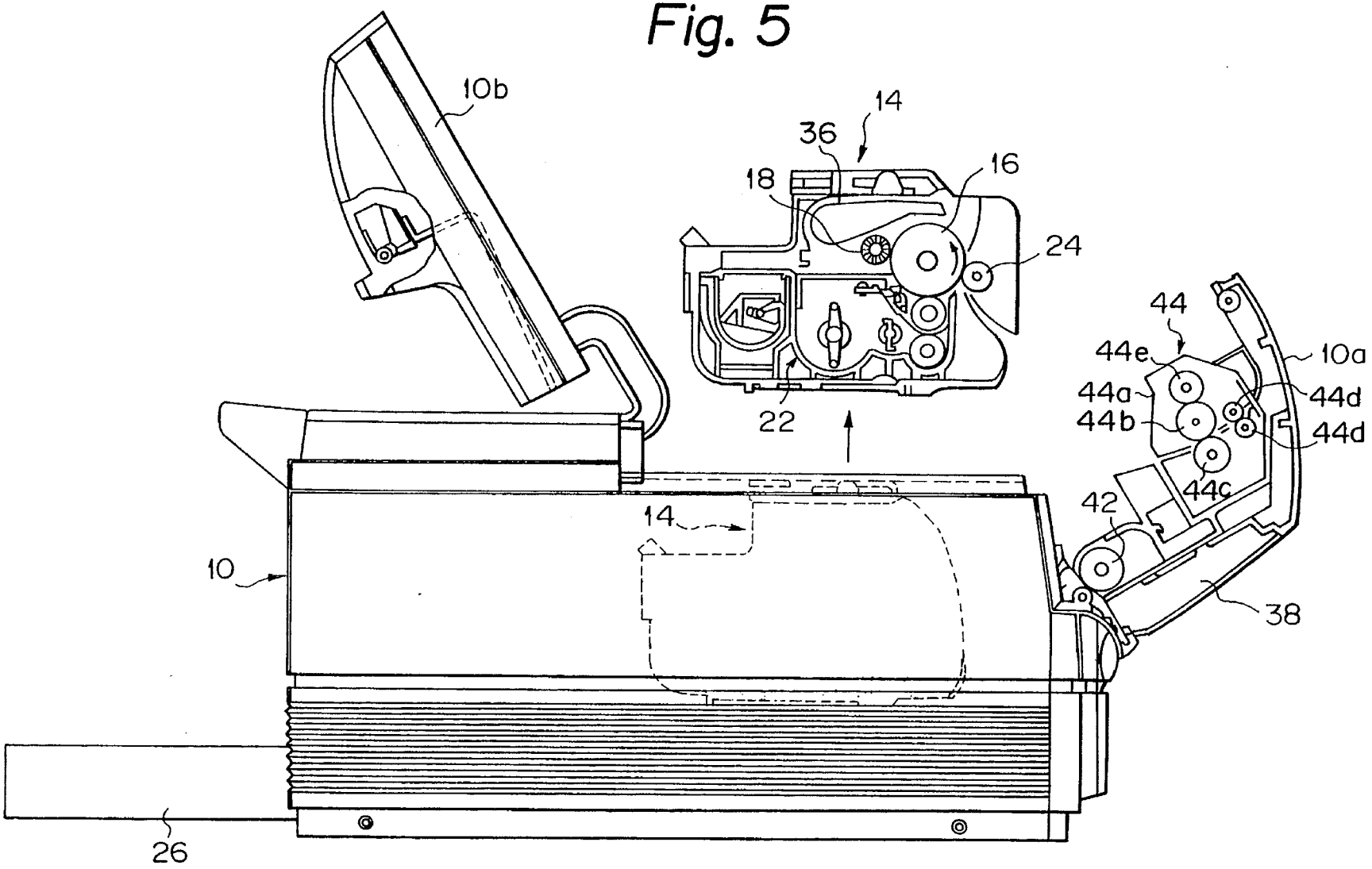
FIG. 5 is a side view of the laser printer shown in FIG. 1, in which the front and upper covers are opened to remove a printing unit from the laser printer.

FIG. 4 schematically shows a part of an interior arrangement of the printer shown in FIGS. 1 to 3. The printer comprises a printing unit 14 provided in the housing 10, and the printing unit 14 prints on a recording medium such as a sheet of paper. As shown in FIG. 5, when the front and upper covers 10*a* and 10*b* are opened, the printing unit 14 is removable from the housing 10, and thus a maintenance of the printer can be easily carried out.

Figure 6:
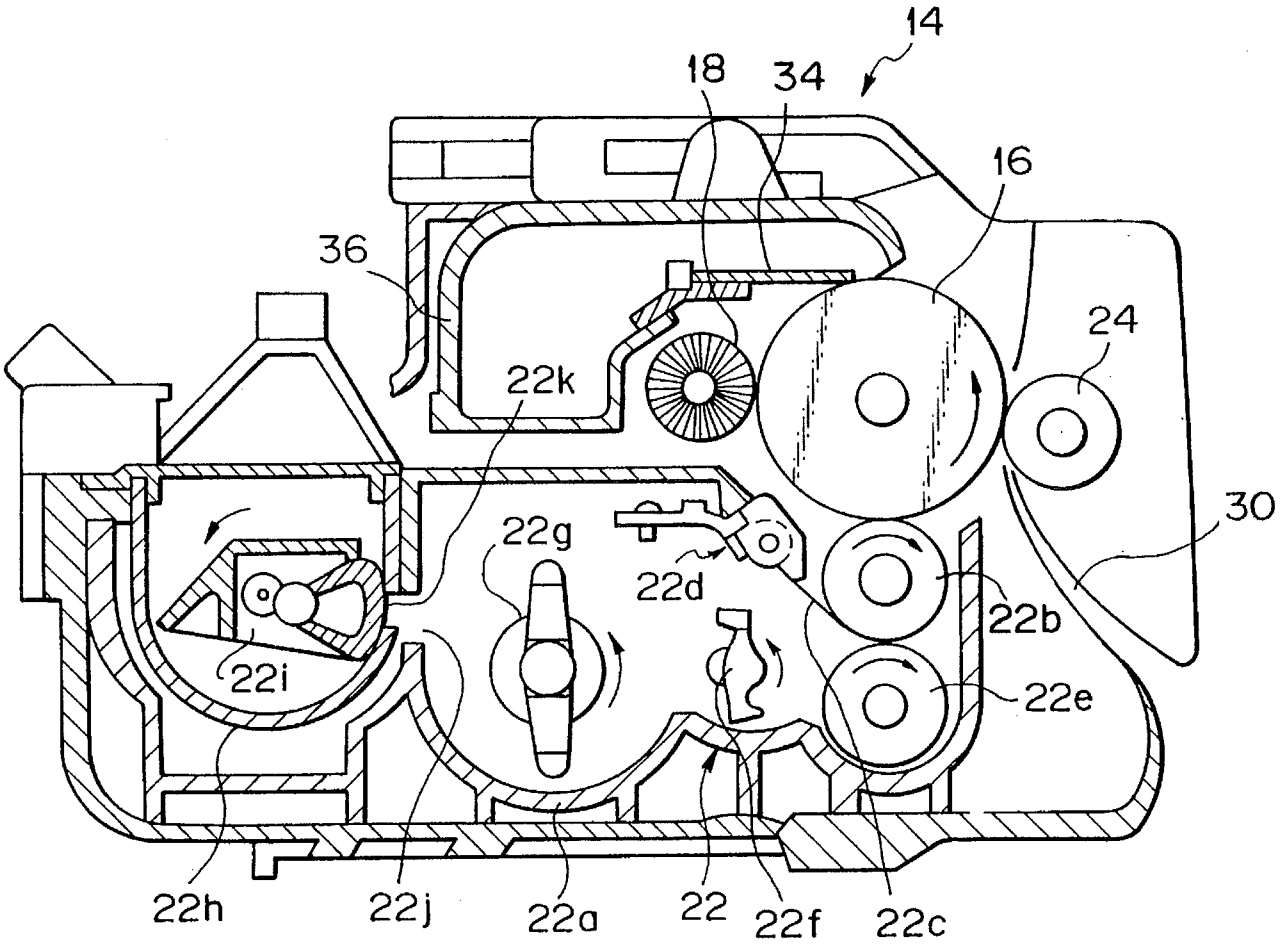
FIG. 6 is an enlarged sectional side view of the printing unit shown in FIG. 5.

As best shown in FIG. 6, the printing unit 14 comprises a rotary photosensitive drum 16 formed as a latent image carrying body and rotated in a direction indicated by an arrow in FIG. 6 during an operation of the printer. The drum 16 may be made of an aluminum cylindrical hollow member and a photoconductive insulating film bonded to a cylindrical surface thereof. In this embodiment, the photoconductive insulating film is made of an organic photoconductor (OPC).

The printing unit 14 also comprises a conductive brush type charger 18, formed of a plurality of conductive filaments, which is rotated such that the free ends of the filaments are in contact with the photosensitive drum 16. The charger 18 is connected to an electronic power source (not shown) to give an electric charge to the photoconductive insulating film of the drum 16, so that a uniform distribution of the charge is produced on the drum 16. For example, the charged area of the drum 16 may have a potential of about −650 volts. As shown in FIG. 4, the printer comprises a laser beam scanner 20 including a laser source such as a semiconductor laser diode for emitting a laser light, an optical system for focusing the laser light into a laser beam LB, and an optical scanning system such as a polygon mirror for deflecting the laser beam LB along a direction of a central axis of the drum 16, so that the charged area of the drum 16 is scanned by the deflecting laser beam LB. During the scanning, the laser beam LB is switched on and off on the basis of binary image data obtained from, for example, a word processor, computer or the like, so that an electrostatic latent image is written as a dot image on the charged area of the drum 16. In particular, when a zone of the charged area is irradiated by the laser beam LB, the charges are released from the irradiated zone so that the latent image is formed as a potential difference between the irradiated zone and the remaining zone.

The printing unit 14 further comprises a developing device 22 for electrostatically developing the latent image with a non-magnetic type developer composed of, for example, a polyester resin-based toner Component, i.e,, colored fine polyester resin particles. The developing device 22 includes a vessel 22*a* for holding the developer or toner, and a developing roller 22*b* provided within the vessel 22*a* in such a manner that a portion of the developing roller 22*b* is exposed therefrom and pressed against the surface of the photosensitive drum 16 to establish a given nip width therebetween. The developing roller 22*b* is constituted as a conductive foam rubber roller, which may be formed of a conductive polyurethane foam rubber material, urethane foam rubber material, conductive silicone foam rubber material or the like, so that pore openings appear on the surface of the developing roller 22*b*. During the operation of the printer, the developing roller 22*b* is rotated in a direction indicated by an arrow in FIG. 6, and thus the toner particles are entrained and carried by the surface of the developing roller 12*b* to form a developer or toner layer therearound, whereby the toner particles are brought to the surface of the drum 16 for a development of the latent image formed thereon.

The developing device 22 also includes a blade member 22*c* supported by the vessel 22*a* through attachment fittings, generally indicated by reference 22*d*, such that the blade member 22*c* is engaged with a surface of the developing roller 22*b* to make a thickness of the toner layer formed therearound uniform, whereby an even development of the latent image can be ensured. The blade member 22*c* may be formed of stainless steel having a thickness of about 0.1 mm, and is subjected to an application of a voltage of about −400 volts, so that the toner particles are negatively charged by a charge-injection effect. During the developing process, the developing roller 22*b* is subjected to an application of a developing bias voltage of −300 volts, and the negative charged toner particles electrostatically adhere to only the latent age zone having a potential of about −100 volts. The potential of the latent image zone is increased to −600 volts, as the latent image zone is charged by the negative particles.

The developing device 22 further includes a toner-removing roller 22*e* rotatably provided within the vessel 22*a* and resiliently pressed against the developing roller 22*b*. Similar to the developing roller 22*b*, the toner-removing roller 22*e* is also constituted as a conductive foam rubber roller, which may be formed of a conductive polyurethane foam rubber material, urethane foam rubber material, conductive silicone foam rubber material or the like, so that pore openings appears on the surface of the toner-removing roller 22*e*. During the operation of the printer, the toner-removing roller 22*e* is rotated in the same direction as the developing roller 22*b*, as indicated by an arrow in FIG. 6, so that the surfaces of the rollers 22*b* and 22*e* are rubbed against each other in reverse directions at the contact zone therebetween, whereby residual toner particles not used for the development of the latent image are mechanically removed from the developing roller 22*b*. On the other hand, the toner-removing roller 22*e* serves to feed the toner particles to the developing roller 22*b* at one side of the nip therebetween (i.e., the left side in FIG. 6), because the toner particles entrained by the toner-removing roller 22*e* are moved toward the nip between the rollers 22*b* and 22*e*. The toner-removing roller 22*e* is subjected to an application of a voltage of about –400 volts to thereby be negatively charged, so that a penetration of the toner particles thereinto can be prevented.

Figure 7:
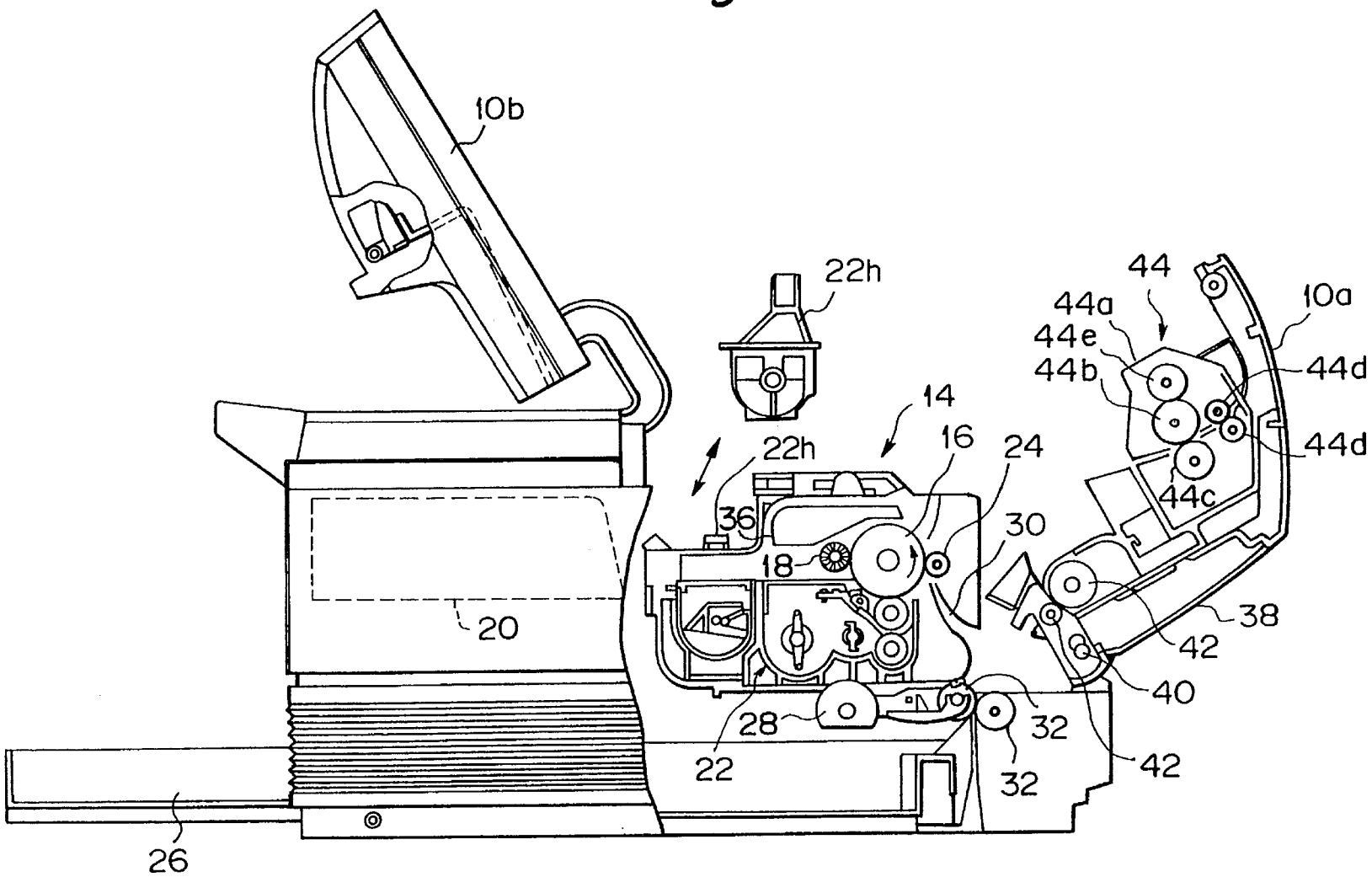
FIG. 7 is a partially cutaway side view of the laser printer as shown in FIG. 1, in which the front and upper covers are opened for an exchange of a toner tank.

The vessel 22*a* may be provided with a paddle roller 22*f* and an agitator 22*g* rotated in directions indicated by arrows in FIG. 6, respectively. The paddle roller 22*f* serves to move the toner particles toward the toner-removing roller 22*e*, and the agitator 22*g* agitates the body of the toner to stop the toner being caught by on the edges of the vessel 22*a*. Also, the developing device 22 may also be provided with a developer-supplying tank 22*h* detachably received therein and having a paddle blade 22*i* rotated in a direction indicated by an arrow in FIG. 6. The vessel 22*a* has an opening 22*j* formed in a side wall thereof, and the tank 22*h* has a port 22*k* formed therein. The vessel 22*a* is in communication with the tank 22*h* through the opening 22*j* and the port 22*k*, as shown in FIG. 6. When a predetermined amount of the developer is consumed from the vessel 22*a*, the rotation of the paddle blade 22*i* is carried out, whereby the developer is fed from the tank 22*h* to the vessel 22*a*. When the tank 22*h* becomes empty, it is exchanged for a new one, as shown in FIG. 7.

The printing unit 14 further includes a conductive roller type transfer charger 24 for electrostatically transferring the developed toner image from the photosensitive drum 16 to a sheet of paper. Further, the transfer charger 24 may be formed of a conductive polyurethane foam rubber material, urethane foam rubber material, conductive silicone foam rubber material or the like, so that pore openings appears on the surface thereof. The transfer roller 24 is resiliently pressed against the drum 16, and is subjected to an application of electrical energy so that positive charges are supplied to the paper, whereby the negatively-charged toner image can be electrostatically attracted to the paper.

As shown in FIG. 4, the printer is provided with a detachable paper cassette 26 in which a stack of cut sheet paper is received, and the paper cassette 26 has a paper feeding roller 28 incorporated therein. A paper guide 30 is extended from an paper exit of the paper cassette 26 toward a nip between the drum 16 and the transfer roller 24, and has a pair of register rollers 32 and 32 associated therewith. During the printing operation, papers to be printed are fed one by one from the stack of paper by driving the paper feeding roller 28. The fed paper is stopped once at the register roller 32 and 32, and is then introduced into said nip through the paper guide 30 at a given timing, so that the developed toner image can be transferred to the paper in place by the transfer roller 24.

In the toner image transferring process, the developed toner image cannot be completely transferred from the drum 16 to the paper. Namely, a part of the developed toner image is inevitably left as residual toner particles on the surface of the drum 16. The residual toner particles are removed from the drum surface by a scraper type blade 34 applied thereto (FIG. 6), and the removed toner particles are received in a vessel 36.

In the illustrated printer, a cut sheet paper can be manually introduced into the nip between the drum 16 and the transfer roller 24. To this end, the front cover 10*a* has a movable guide plate 38 associated therewith, and the guide plate 38 is rotatable at a pivot pin 40. When the guide plate 38 is moved outward from a vertical position shown in FIG. 4 to a horizontal position, the cut sheet paper can be manually set on the horizontally positioned guide plate 38 such that the leading edge thereof is abutted to a nip between a pair of paper feeding rollers 42 and 42. By driving the paper feeding rollers 42 and 42, the cut sheet paper is fed to the nip between the drum 16 and the transfer roller 24.

The paper discharged from the nip between the drum 16 and the transfer roller 24, i.e., the paper carrying with the transferred toner image is then moved toward a toner image fixing device 44 along a paper guide 46 extended between the transfer roller 24 and the fixing device 44, for thermally fusing and fixing the transferred toner image on she paper. As apparent from FIGS. 4 and 5, the fixing device 44 comprises a frame housing 44*a* supported by the movable front cover 10*a*, a heat roller 44*b* rotatably supported by the frame housing 44*a*, and a backup roller 44*c* rotatably supported by the frame housing 44*a* and engaged with the heat roller 44*b* to form a nip therebetween. The rollers 44*b* and 44*c* are rotated in respective directions indicated by arrows in FIG. 4 during an operation of the printer.

The paper carrying with the transferred toner image is introduced into the nip between the rollers 44*b* and 44*c* through the paper guide 46. While the paper is passed through said nip, the toner image thereon is in direct contact with the heat roller 44*b*, and thus is thermally fused and fixed on the paper. The paper carrying with the fixed toner image is discharged from the frame housing 44*a* by a pair of paper guide rollers 44*d* and 44*d* provided therein. Thus, the paper passed through the fixing device 44 is discharged from the printer through a pair of paper discharging rollers 46 and 46, and then the discharged paper are successively stacked on the top surface of the upper cover 10*b*. During the toner image fixing process, a small part of the fused toner may adhere to a surface of the heat roller 44*b*, and could then stain sheets of paper which are successively fed to the toner fixing device 44. For this reason, the toner fixing device 44 is provided with a cleaning roller 44*e* resiliently pressed against the heat roller 44*b* for removing the fused toner stain therefrom.

Figure 8:
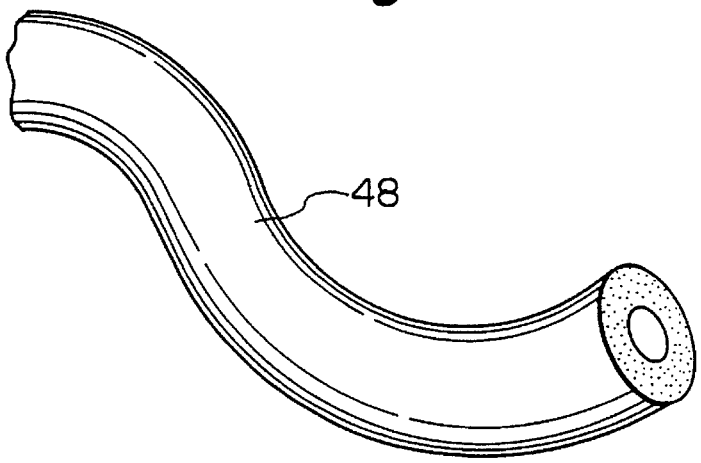
FIG. 8 is a perspective view showing an extruded long tubular product formed of a suitable resin material containing a conductive substance and a water-soluble foam-providing substance.
Figure 9:
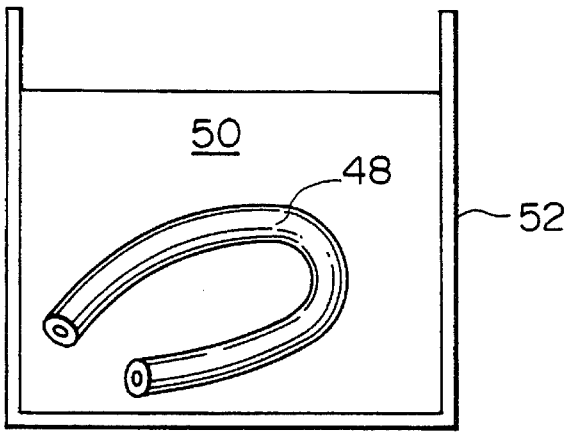
FIG. 9 is a schematic view showing a container holding a body of water in which the tubular product of FIG. 8 is immersed so that the water-soluble foam-providing substance dissolves in the body of water to produce a tubular foam product.
Figure 10:
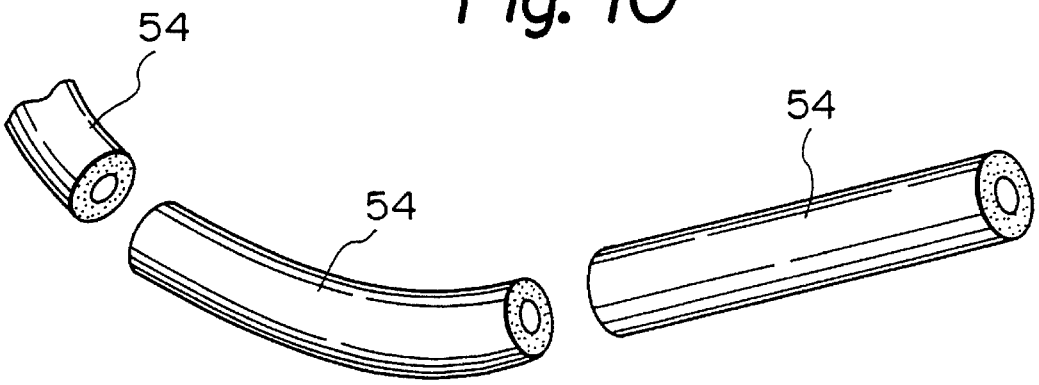
FIG. 10 is a perspective view showing tubular roller elements cut from the tubular foam product of FIG. 9.

A first aspect of the present invention is directed to the conductive foam rubber roller used as the developing roller 22*b* or the transfer roller 24, and the conductive foam rubber roller can be produced by substantially the same processes as mentioned hereinbefore. Namely, a suitable resin material, such as polyurethane, silicone or the like, containing a conductive filler such as carbon black or a fine metal powder, and a water-soluble foam-providing substance such as polyvinyl alcohol or methyl cellulose is extruded as a long tubular product 48, as shown FIG. 8; the extruded tubular product 48 is immersed in a body of water 50 held by a container 52, as shown in FIG. 9, so that the water-soluble foam-providing substance dissolves in the body of water 50 so that a foam structure is given to the tubular product 48; and this tubular foam product is cut into tubular roller elements 54 having a predetermined length, as shown in FIG. 10. Of course, in the extrusion process, the amount of the conductive filler is selected so that a desired resistivity can be given to the tubular foam product 48, and also the amount of the water-soluble foam-providing substance is selected so that a desired density of cells can be given to the tubular foam product 48.

Figure 11:
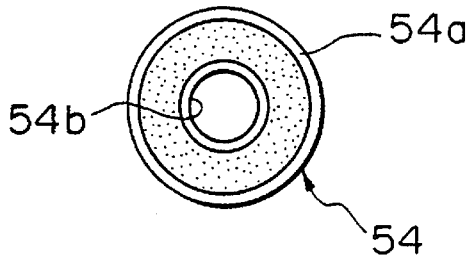
FIG. 11 is an end view of the tubular roller element of FIG. 10.

Each tubular roller element 54 is covered at an outer wall surface thereof by a solid skin layer 54*a*, and also an inner solid skin layer 54*b* is formed at an inner wall surface of a central bore of the tubular roller element 52, as shown in FIG. 11. The formation of these solid skin layers 54*a* and 54*b* is inevitable in the above-mentioned processes for the production of the tubular roller element 54, and a content of the conductive filler in the solid skin layers 54*a* and 54*b* is very small in comparison with that of the conductive filler in the internal foam structure of the tubular roller element 54, so that the electrical resistivity of the solid skin layers 54*a* and 54*b* is considerably higher than that of the inner foam structure of the tubular roller element 54. Also, each of the solid skin layers 54*a* and 54*ba* has a thickness of from about 1 to about 5 μm, and this thickness is variable along a longitudinal axis of the tubular roller element 54.

Figure 12:
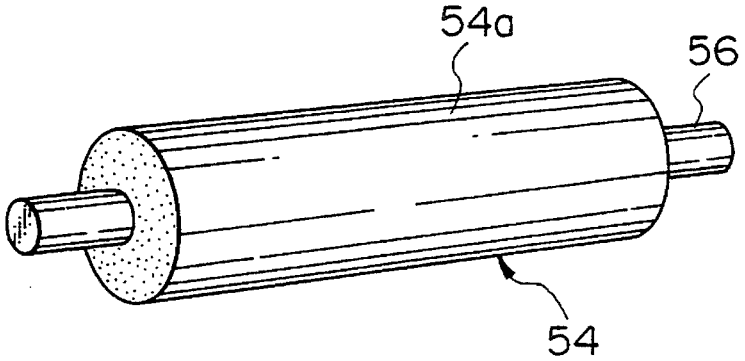
FIG. 12 is a perspective view showing a conductive foam rubber roller produced by mounting the tubular roller element on a metal shaft member.
Figure 13:
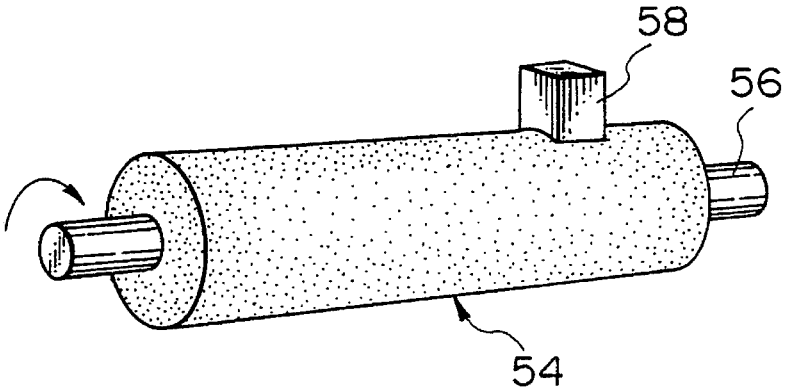
FIG. 13 is a perspective view showing a removal of an outer solid skin layer of the conductive foam rubber roller of FIG. 12 by an application of an abrasive stone.

As shown in FIG. 12, the tubular roller element 54 is mounted and fixed on a metal shaft member 56 by using a suitable adhesive such as a thermosetting adhesive, and then the solid skin layer 54*a* of the tubular roller element 54 is removed by applying an abrasive stone 58 to the tubular roller element 54 during a rotation of the conductive foam rubber-roller, as shown in FIG. 13, whereby pore openings appear on the surface of the tubular roller element 54. Thus, a conductive foam rubber roller for use as the developing roller 22*b*, the toner-removing roller 22*e*, or the transfer roller 24 can be obtained, but this conductive foam rubber roller cannot be directly be put to use, because a sufficient electrical contact between the tubular roller element 54 and the metal shaft member 56 cannot be ensured due to the existence of the solid skin layer 54*b* therebetween, which exhibits a high resistivity for lack of the conductive filler dispersed therein. Note, when the conductive foam rubber roller element 54 is subjected to an application of electrical energy, the supply of the electrical energy to the conductive foam rubber element is carried out through the intermediary of the metal shaft member 56.

Figure 14:
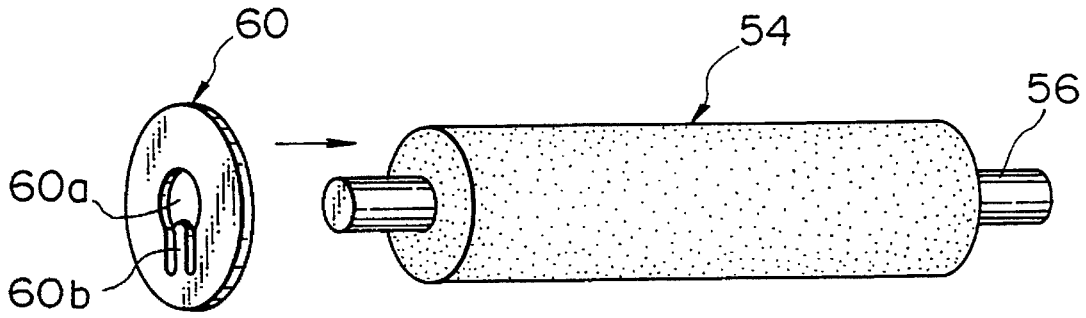
FIG. 14 is a perspective view showing a production of a conductive foam rubber roller according to the present invention.
Figure 15:
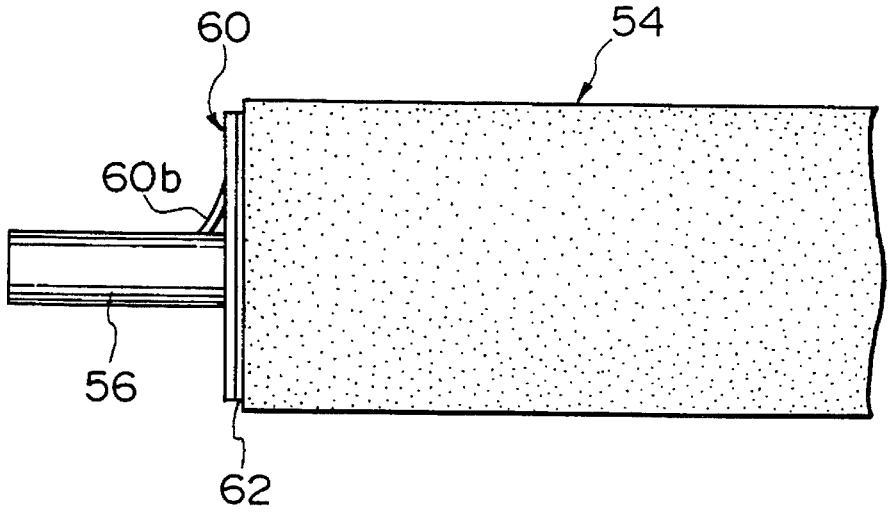
FIG. 15 is a partial side view showing the conductive foam rubber roller obtained according to the production of FIG. 14.

In accordance with the first aspect of the present invention, a sufficient electric contact between the tubular roller element 54 and the metal shaft member 56 is established by an electric contact establishing means provided therebetween. In an embodiment as shown in FIGS. 14 and 15, the electric contact establishing means comprises a disc-like contact member 60 formed of a suitable metal material such as copper and having a central opening 60*a* formed therein, a diameter of which is slightly larger than that of the metal shaft member 56, and a tongue element 60*b* integrally formed therein, a free end of which is slightly projected in the central opening 60*a*. The contact member 60 is inserted onto the metal shaft member 56 from one end thereof, as shown in FIG. 14, and is then abutted against and adhered to an end face of the tubular roller element 54 with a suitable conductive adhesive 62, as shown in FIG. 15. Of course, the disc-like contact member is applied to the other face of the tubular roller element 54 in the same manner as mentioned above. Thus, a sufficient electric contact can be established between the metal shaft member 56 and the foam structure of the tubular roller element 54. Note, there is no solid skin layer at the end faces of the tubular roller element 54. Alternatively, the contact member 60 may be adhered to the end face of the tubular roller element 54 by thermally fusing a material of the foam structure of the tubular roller element 54 at the end face thereof.

In fact, a plurality of conductive foam rubber rollers were produced by the processes as mentioned above, and an amount of the conductive filler was selected so that a volume resistivity of $10^6$ Ω.cm could be given to the foam structure of each conductive tubular roller element. In this case, it was found that a volume resistivity of the produced conductive foam rubber rollers fell in a range of from about $10^6$ Ω.cm to about $10^7$ Ω.cm.

Figure 16:
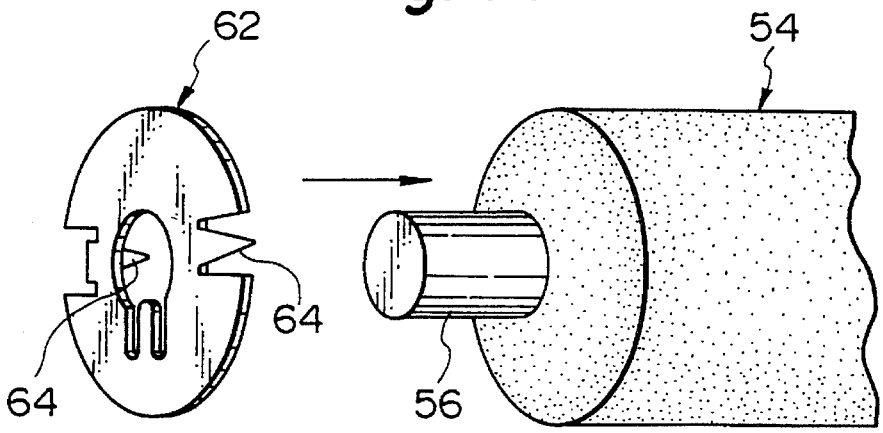
FIG. 16 lea partial perspective view showing a production of a conductive foam rubber roller according to a prior art.
Figure 17:
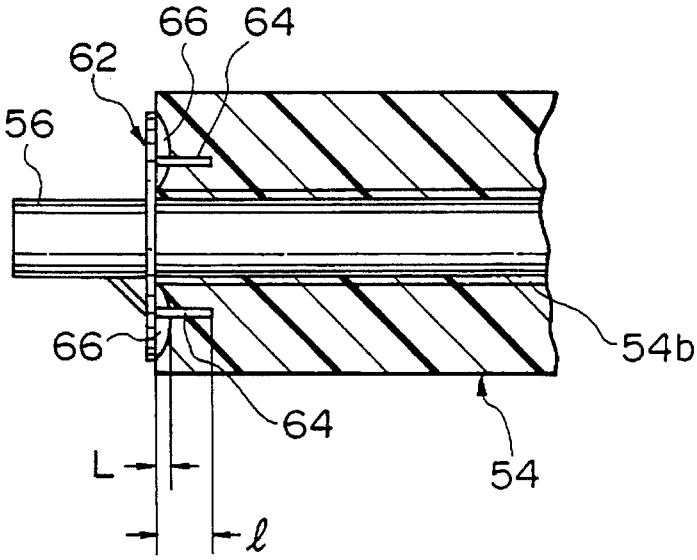
FIG. 17 is a partial longitudinal-sectional view showing the conductive foam rubber roller according to the production of FIG. 16.

U.S. patent application Ser. No. 971,214, which was filed by the same applicant on Nov. 4, 1992, discloses that a disc-like metal contact member is merely pressed against the end face of the tubular roller element for establishing an electric contact between the tubular roller element and the metal shaft member. Also, U.S. patent application Ser. No. 971,214 discloses another type of disc-like metal contact member as indicated by reference 62 in FIG. 16. This contact member 62 is similar to the contact member 60, but it is provided with a pair of nail-like elements 64 diametrically formed therein. The nail elements 64 are penetrated into the foam structure of the tubular roller element 54 when the metal disc-like member 62 is abutted against the end face thereof, as shown in FIG. 17. Accordingly, an sufficient electric contact between the tubular roller element 54 and the metal shaft member 56 must be obtained due to the penetration of the nail-like elements 64 into the foam structure of the tubular roller element 54. Nevertheless, the sufficient electric contact cannot be always ensured between the tubular roller element 52 and the metal shaft member 56, because the end face of the tubular roller element 54 can be frequently depressed, as indicated by references 66 in FIG. 17, at a localized zone at which the nail-like elements 64 are penetrated into the foam structure of the tubular roller element 54, For example, when a length (l) of the nail-like element 64 is 6.0 mm, a depth (L) of the depression 66 is from about 2 mm to about 4 mm. Of course, the depression 66 of the end face of the tubular roller element 54 can impede an establishment of the sufficient electric contact between the tubular roller element 54 and the metal shaft member 56.

Figure 18:
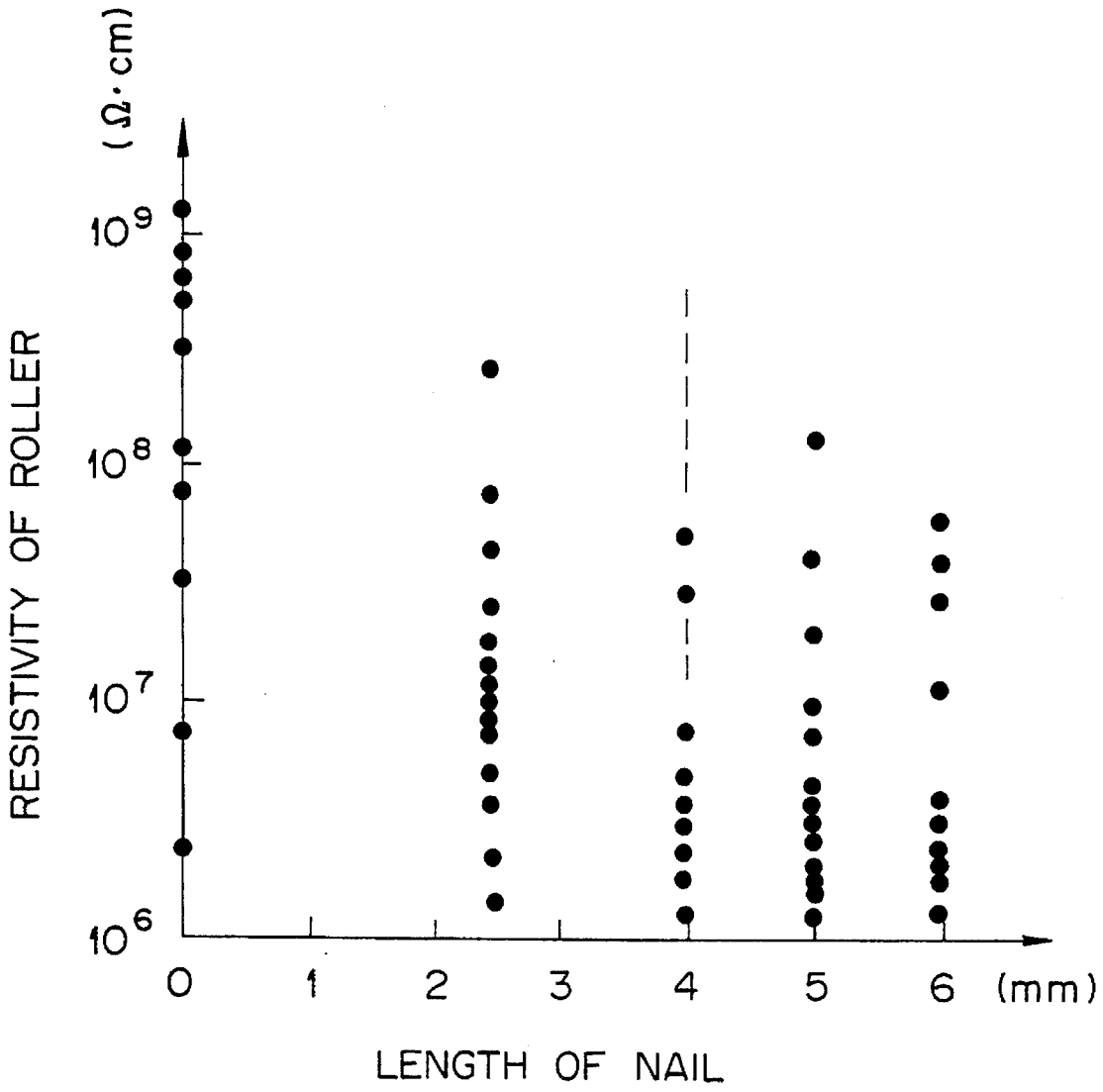
FIG. 18 is a graph showing a distribution of volume resistivity of the conductive foam rubber rollers obtained according to the production of FIG. 16.

In fact, a plurality of conductive foam rubber rollers were produced in accordance with the processes disclosed in U.S. patent application Ser. No. 971,214, and the amount of the conductive filler was selected so that a volume resistivity of $10^6$ Ω.cm was be given to the foam structure of each conductive tubular roller element. In this case, the volume resistivity of the produced conductive foam rubber rollers fell in a wider range than that in the case according to the present invention, as shown the graph of FIG. 18. As apparent from this graph, when the disc-like-metal contact member is merely pressed against the end face of the tubular roller element, i.e., when the length of the nail-like element is zero, the volume resistivity of the conductive foam rubber rollers fell in a range of from about $10^6$ Ω.cm to about $10^9$ Ω.cm. Also, for example, when the length of the nail-like element is 6 mm, the volume resistivity of the conductive foam rubber rollers fell in a range of from about $10^6$ Ω.cm to about $10^8$ Ω.cm. On the contrary, the volume resistivity of the conductive foam rubber rollers produced in accordance with the present invention can fall in the narrower range of from about $10^6$ Ω.cm to about $10^7$ Ω.cm, as mentioned above.

When the contact member 60 is adhered to the end face of the tubular roller element 54 by using a conductive adhesive or by thermally fusing a material of the foam structure of the tubular roller element 54 at the end face thereof, the adhesive area should be made larger as much as possible. Namely, the adhesive area S should at least satisfies the following formula:

$$I/S \leqq 0.1$$

wherein I indicates a current (μA) flowing between the tubular roller element 54 and the metal shaft member 56. When the conductive foam rubber roller having the ratio of I to S exceeding the value of 0.1 is used as the developing roller 22b of the developing device 22 as mentioned above, an absolute value of the potential (–400 volts) of the developing roller 22b is increased due to the negatively-charged developer, to thereby cause a photographic fog.

Figure 19:
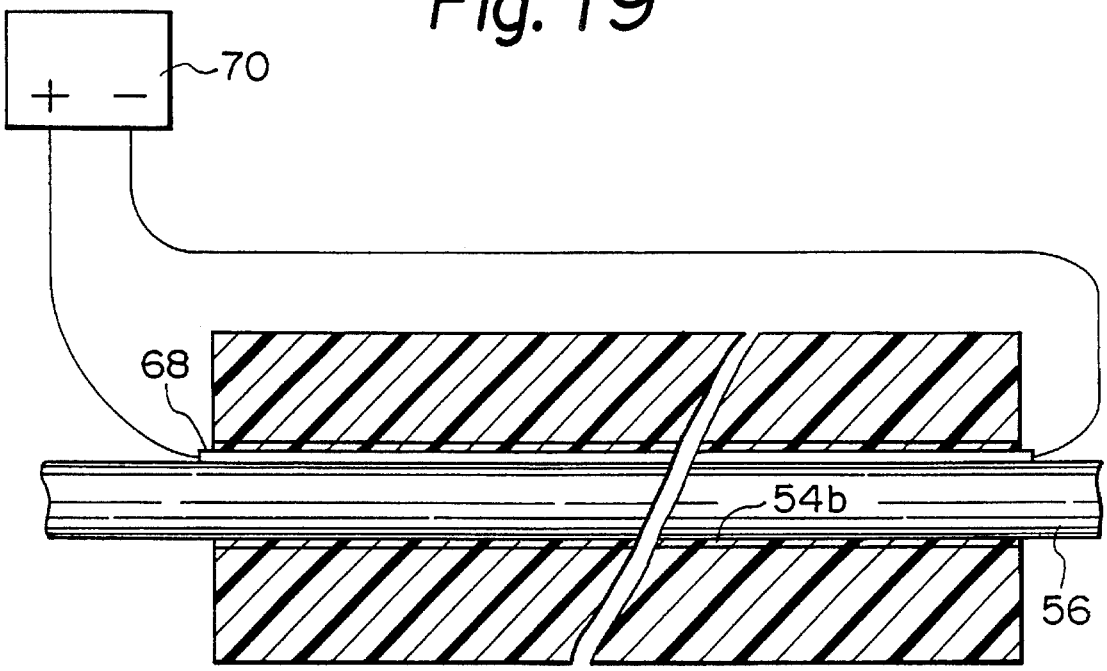
FIG. 19 is a longitudinal-sectional view showing a production of another type conductive foam rubber roller according to the present invention.
Figure 20:
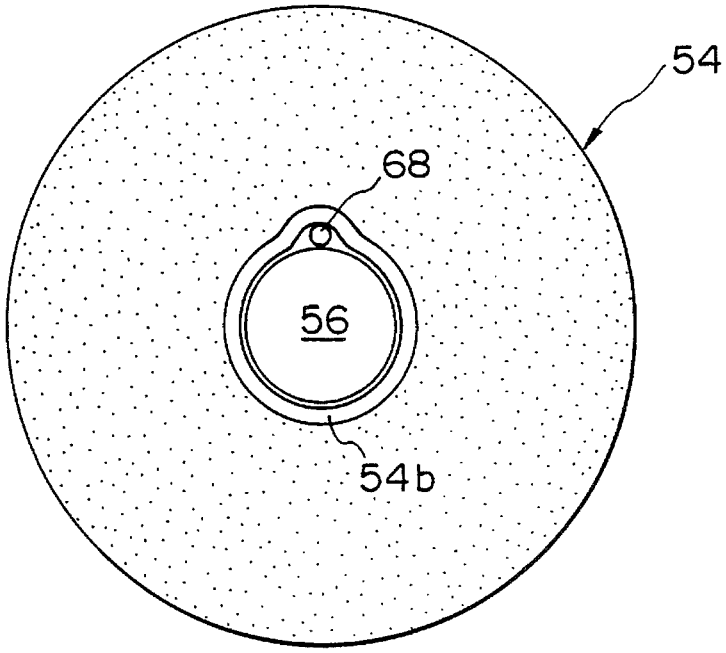
FIG. 20 is an end view of the conductive foam rubber roller shown in FIG. 19.

FIGS. 19 and 20 show another embodiment for establishing sufficient electric contact between the tubular roller element 54 and the metal shaft member 56. In this embodiment, when the tubular roller element 54 is mounted and fixed on the metal shaft member 56, an electric heater element 68 is simultaneously extended through the central bore of the tubular roller element 54. The electric heater element 68 is subjected to an application of electrical energy from an electric source 70, and a part of the inner solid skin layer 54b of the tubular roller element 54 is thereby thermally fused and broken by the electrically-energized heater element 68. Then, the electric heater element 68 is drawn out of the central bore of the tubular roller element 54, so that the metal shaft is directly adhered to the internal foam structure of the tubular roller element 54 having the larger amount of the conductive filler. Thus, the sufficient electric contact can be established between the tubular roller element 54 and the metal shaft member 56.

Note, in the embodiments shown in FIGS. 14 and 15 and FIGS. 19 and 20, of course, the removal of the outer solid skin layer 54a of the tubular roller element 54 may be carried out after the electric contact is established between the tubular roller element 54 and the metal shaft member 56.

Figure 21:
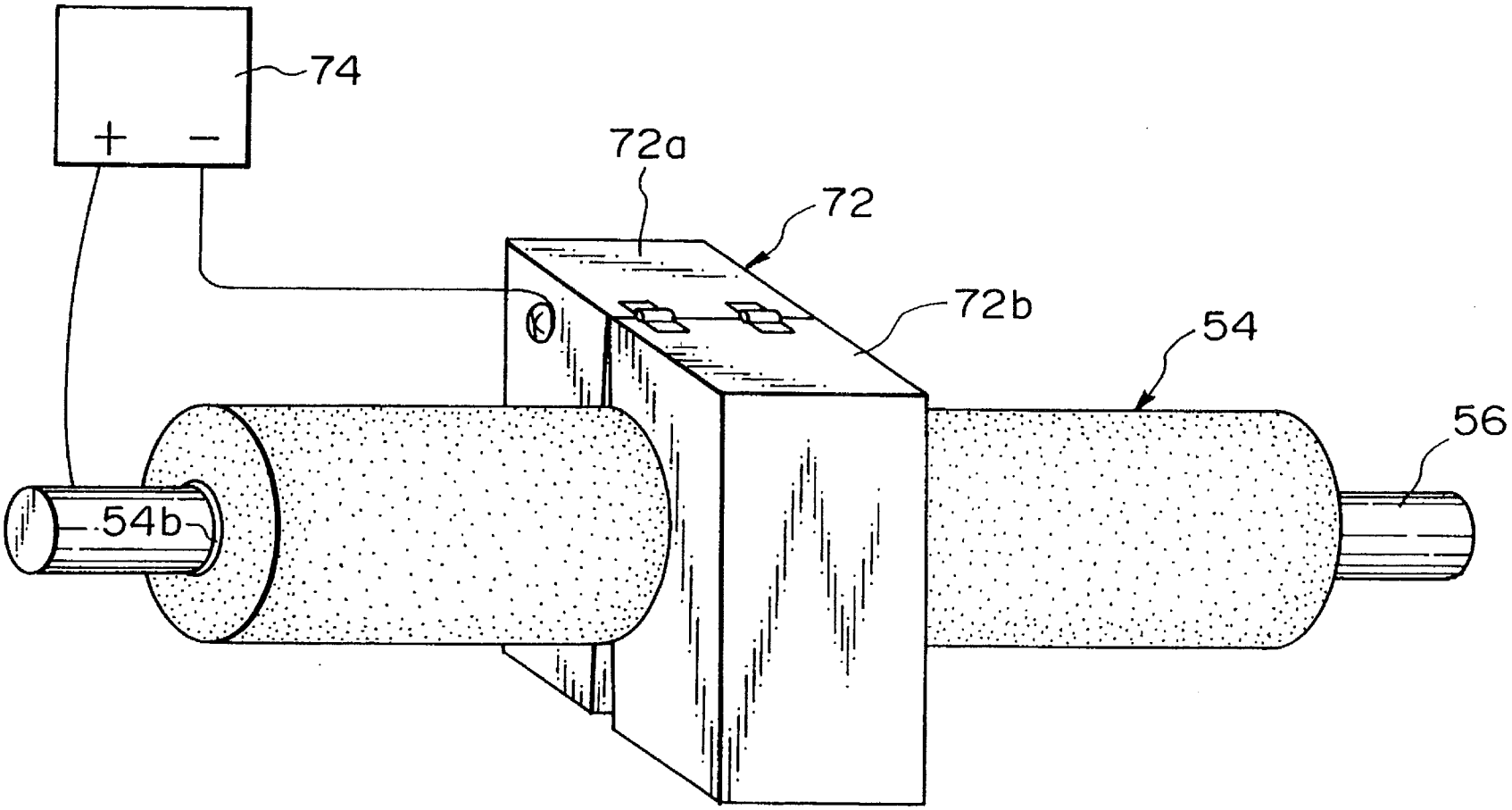
FIG. 21 is a perspective view showing the production of yet another type conductive foam rubber roller according to the present invention.

FIG. 21 shows yet another embodiment for establishing a sufficient electric contact between the tubular roller element 54 and the metal shaft member 56. In this embodiment, after the tubular roller element 54 is mounted and fixed on the metal shaft member 56, a high voltage is applied between the tubular roller element 54 and the metal shaft member 56 to perform an electrical insulation-breakage of the inner solid skin layer 54b. In particular, a split type electrode 72 including two block members 72a and 72b hinged to each other is attached to the tubular roller element 54, as shown in FIG. 21, and the metal shaft member 56 and the electrode 72 are connected to a high voltage source 74. The inner solid skin layer 54b can be electrically broken by, for example, applying a high voltage of 1 kV from the high voltage source 74 between the tubular roller element 54 and the metal shaft member 56. Namely, the inner solid skin layer 54b are locally fused due to a concentration of the electrical current at a location of the inner solid skin layer 54b having a relatively smaller resistivity. Thus, the sufficient electric contact can be established between the tubular roller element 54 and the metal shaft member 56.

Figure 22:
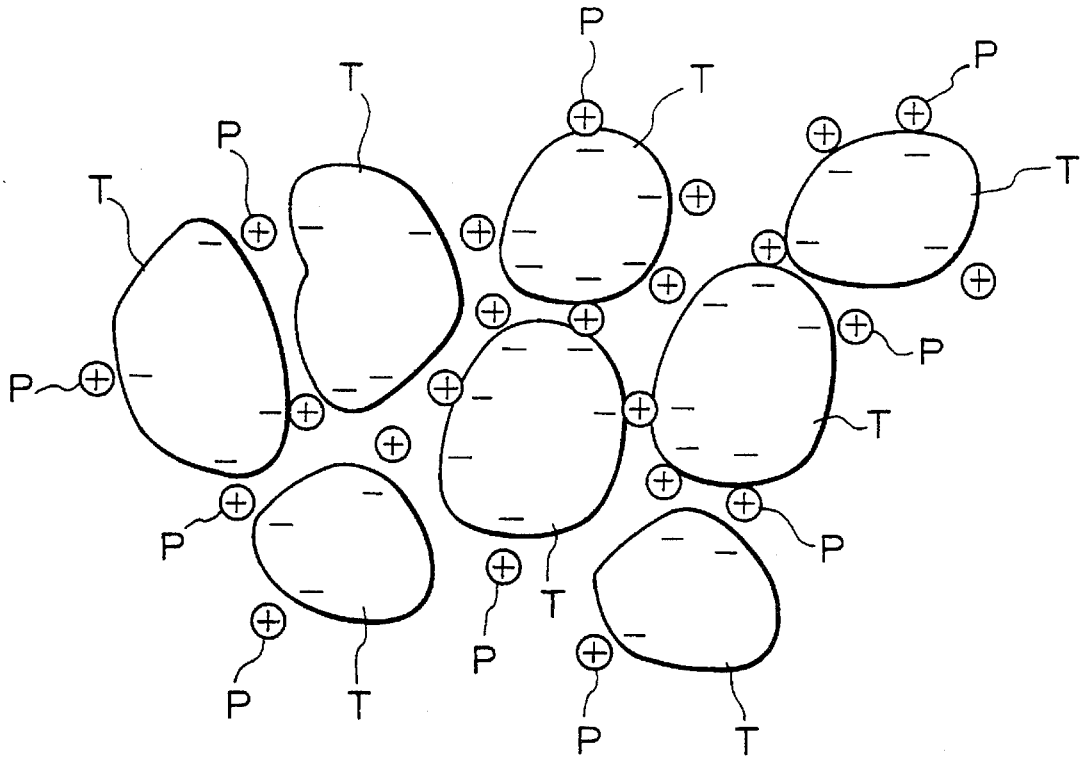
FIG. 22 is a schematic view of a non-magnetic type developer composed of a toner component and a resin powder component, one component of which has a polarity opposite to that of the other component by triboelectrification therebetween.

A second aspect of the present invention is directed to the developing device 22 using the non-magnetic type developer inclusive of a resin powder component as an additional component, which has a polarity opposite to that of an electric charge of the toner component by a triboelectrification therebetween. Since the developer composed of the polyester resin-based toner component is negatively charged, as mentioned above, the resin powder component should be formed of melamine resin, acrylic resin, styrene acrylic resin or the like. Namely, the resin powder component formed of melamine resin, acrylic resin or styrene acrylic resin can be positively charged by the triboelectrification with the polyester resin-based toner component, as shown in FIG. 22, in which the toner component and the resin powder component are indicated by T and P, respectively. A diameter of the toner component T is larger than that of the resin powder component P. For example, when the toner component has an average diameter of about 10 μm, the resin powder component may have an diameter of about 0.3 μm. Also, preferably, the developer includes an amount of 0.5 weight percent to a weight of the toner component.

Although the developer includes a resin powder component, the toner component cannot be sufficiently charged by only triboelectrification with the resin powder component. Accordingly, it is necessary to further charge the toner component of the developer by the charge-injection effect derived from the application of –400 volts to the blade member 22c, as mentioned above. If the developer is composed of only toner component, a charge of the charged toner component is partially released therefrom due to the electric field formed between the photosensitive drum 16 and the developing roller 22b, so that some of the toner particles in the toner component may have the reverse charge. Of course, the reversely-charged toner particles result in a photographic fog. On the contrary, according to the second aspect of the present invention, although the charged toner component enters into the electric field formed between the photosensitive drum 16 and the developing roller 22b, the release of a charge of the charged toner component can be prevented due to the existence of the resin powder component included in the developer and reversely charged with respect to the polarity of the charged toner component. Accordingly, a proper development of an electrostatic latent image can be ensured without a photographic fog.

Figure 23:
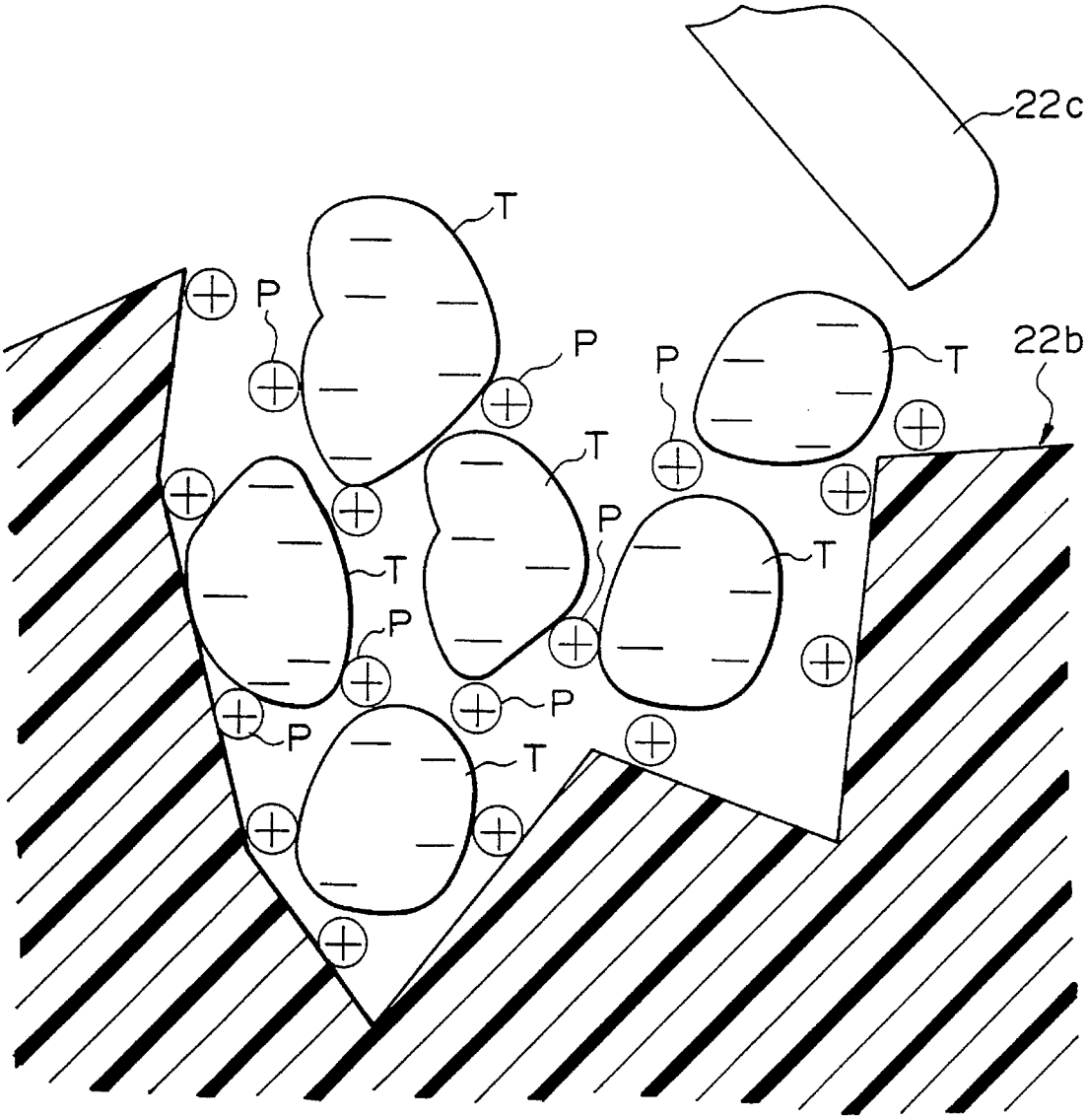
FIG. 23 is a schematic view showing the non-magnetic type developer captured in a pore opening of the conductive foam rubber developing roller.

According to the second aspect of the present invention, the developing device 22 includes a conductive foam rubber developing roller 22b having pore openings, the diameter of the pore openings being from about two and half times to about four times the average diameter of the toner component, whereby a proper and stable development of an electrostatic latent image can be maintained over a longer period of operation. As shown in FIG. 23, not only the toner component T is mechanically captured by the pore openings which appear on the surface of the developing roller 22b, but also the toner component T is electrostatically held through the intermediary of the reversely-charged resin powder component P. In this case, if the diameter of the pore opening of the developing roller 22b is less than two and half times the average diameter of the toner component T, the developing roller 22b is prematurely deteriorated due to a blockage of the developer into the pore openings thereof, and thus a development of an electrostatic latent image cannot be carried out with a sufficient developing density. On the other hand, if the diameter of the pore opening of the developing roller 22b is more than four times the average diameter of the toner component T, the mechanical capture of the toner component T in the pore openings of the developing roller 22b is weakened, and thus a photographic fog occurs.

Figure 24:
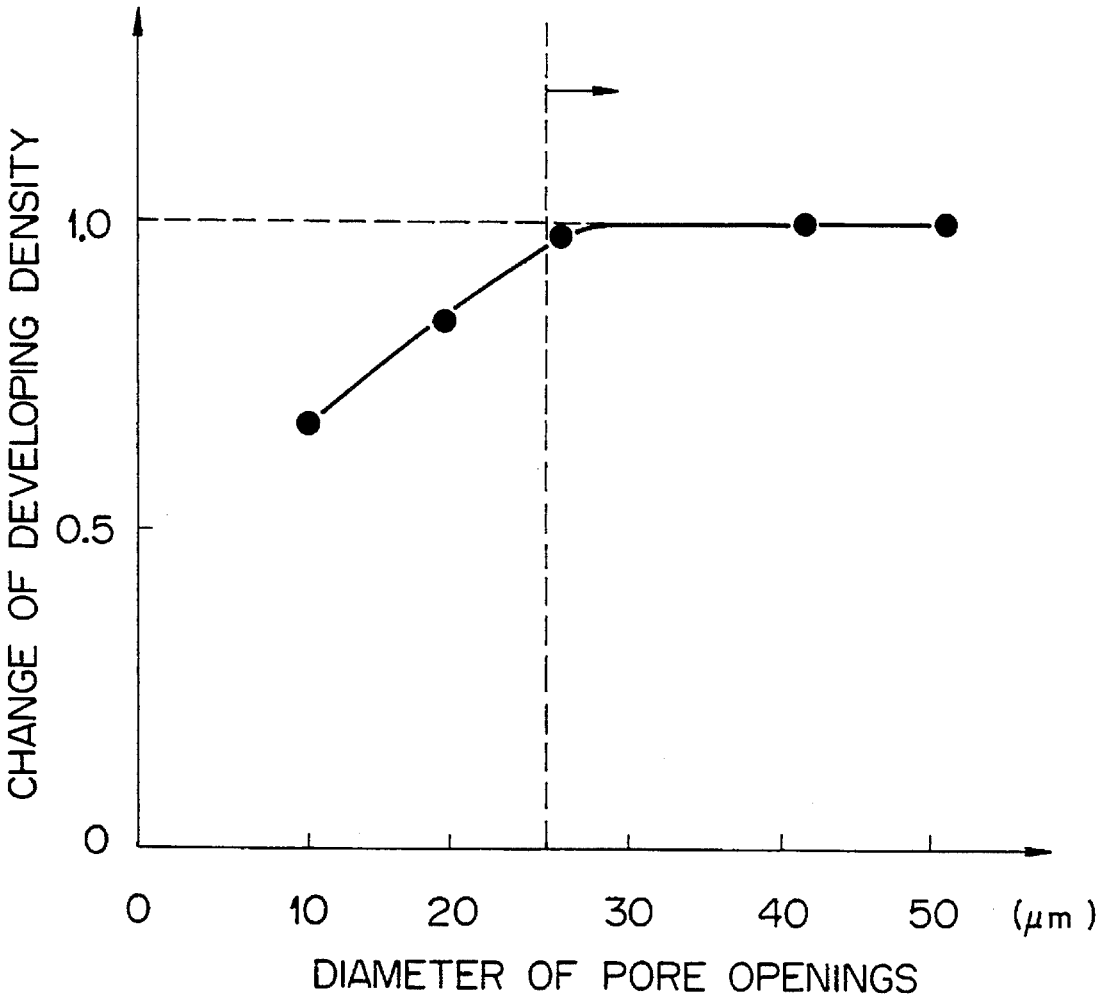
FIG. 24 is a graph showing a ratio of a developing density of the last sheet to a developing density of the initial sheet when making a solid printing on 30,000 sheets of paper by incorporating each of five developing rollers having pore opening diameters of 10, 20, 25, 40, and 50 μm, respectively, into the developing device of the printer as shown in FIGS. 1 to 7.

In fact, five conductive foam rubber developing rollers having pore opening diameters of 10, 20, 25, 40, and 50 μm, respectively, were produced, and a solid printing was continuously made on 30,000 sheets of paper by incorporating each of the developing rollers having the pore opening diameters of 10, 20, 25, 40, and 50 μm, respectively, into the developing device 22 of the printer as shown in FIGS. 1 to 7, and by using the developer composed of a polyester resin-based toner component having an average diameter of about 10 μm, and a melamine resin powder component (0.5 weight percent) having an average diameter of about 0.3 μm. After the number of solidly-printed sheets reached 30,000 on each of the developing rollers having the pore opening diameters of 10, 20, 25, 40, and 50 μm, respectively, a ratio of a developing density of the last sheet to a developing density of the initial sheet was evaluated. The results are shown in a graph of FIG. 24. As apparent from this graph, the developing roller must have the pore opening diameter of more than 25 μm, before an initial developing density can be maintained even after the number of printed sheets has exceeds 30,000. Also, the developing rollers having the pore opening diameter of less than 25 μm were observed after the number of printed sheets has exceeds 30,000, and it was found that the pore openings of the developer rollers had been blocked with developer. This means that the developer cannot be sufficiently entrained due to the blockage of the pore openings with by developer.

Figure 25:
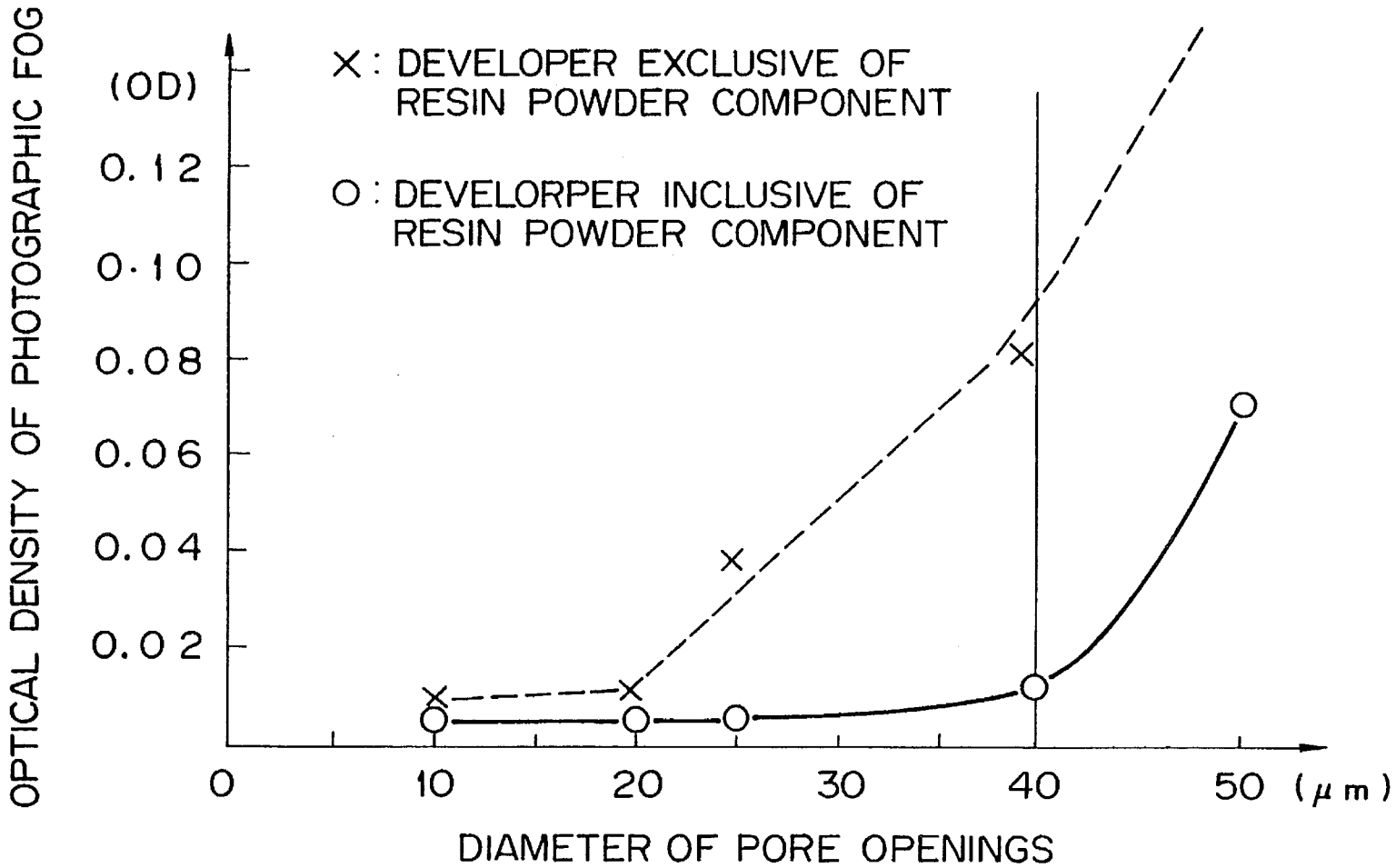
FIG. 25 is a graph showing an optical density of a photographic fog which occurs when operating the printer as shown in FIGS. 1 to 7 in a non-solid printing manner by incorporating each of five developing rollers having the pore opening diameters of 10, 20, 25, 40, and 50 μm, respectively, into the developing device thereof.

Also, the printer as shown in FIGS. 1 to 7 was operated in a non-solid printing manner by incorporating each of the developing rollers having the pore opening diameters of 10, 20, 25, 40, and 50 μm, respectively, into the developing device 22, and by using the developer composed of a polyester resin-based toner component having an average diameter of about 10 μm, and a melamine resin powder component (0.5 weight percent) having an average diameter of about 0.3 μm, and an optical density of a photographic fog occurred on the photosensitive drum 16 was measured. Further, the printer was operated in a non-solid printing manner by incorporating each of the developing rollers having the pore opening diameters of 10, 20, 25, 40, and 50 μm, respectively, into the developing device 22, and by using the developer composed only of a polyester resin-based toner component having an average diameter of about 10 μm. The results are shown in a graph of FIG. 25. As is apparent from this graph, when the developer composed of the toner component and the resin powder component was used, the developing roller must have the pore opening diameter of less than 40 μm, before the optical density of photographic fog can be suppressed less than 0.02 OD (optical density). Also, when the pore opening diameter exceeds 40 μm, the optical density of photographic fog is abruptly increased. This proves that the mechanical capture of the toner component in the pore openings of the developing roller is weakened. On the other hand, when the developer composed of only the toner component was used, the developing roller must have the pore opening diameter of less than 20 μm, before the optical density of photographic fog can be suppressed less than 0.02 OD. Also, when the pore opening diameter exceeds 20 μm, the optical density of photographic fog is abruptly increased. This proves that the hold of the toner component in the pore openings of the developing roller relies upon only a mechanical force.

Furthermore, the volume resistivity of the conductive foam rubber developing roller **22*b* should be selected from a range of from $10^4$ Ω.cm to $10^{10}$ Ω.cm. In particular, when the volume resistivity of the developing roller 22*b* is less than $10^4$ Ω.cm, a high electrical current or an electrical discharge may easily occur between the developing roller 22*b* and the blade member 22*c* due to the potential difference (100 volts) therebetween. Of course, the occurrence of the electric discharge generates heat, to thereby fuse not only the developer but also the developing roller. Also, when the volume resistivity of the developing roller 22*b* is more than $10^{10}$ Ω.cm, the absolute value of the potential of the developing roller 22*b*** is gradually increased, to thereby cause a photographic fog.

Note, the size of the pore openings of the developing roller **22*b*** and the value of the volume resistivity thereof can be easily controlled in the above-mentioned processes for producing the conductive foam rubber roller.

Furthermore, the use of the non-magnetic type developer inclusive of the resin powder component contributes to the transferring process in which the developed toner image is transferred from the photosensitive drum 16 a sheet of paper. In particular, when the developer composed of only the toner component is used, the developed toner image is stuck against the surface of the drum 16 due to the Van der Waals attraction. On the contrary, when the developer inclusive of the resin powder component is used, the Van der Waals attraction acting between the developed toner image and the drum surface can be weakened because of the resin powder component included in the toner image. Thus, it is possible to increase an efficiency of the transfer of the toner image from the drum surface to the sheet of paper.

Figure 26:
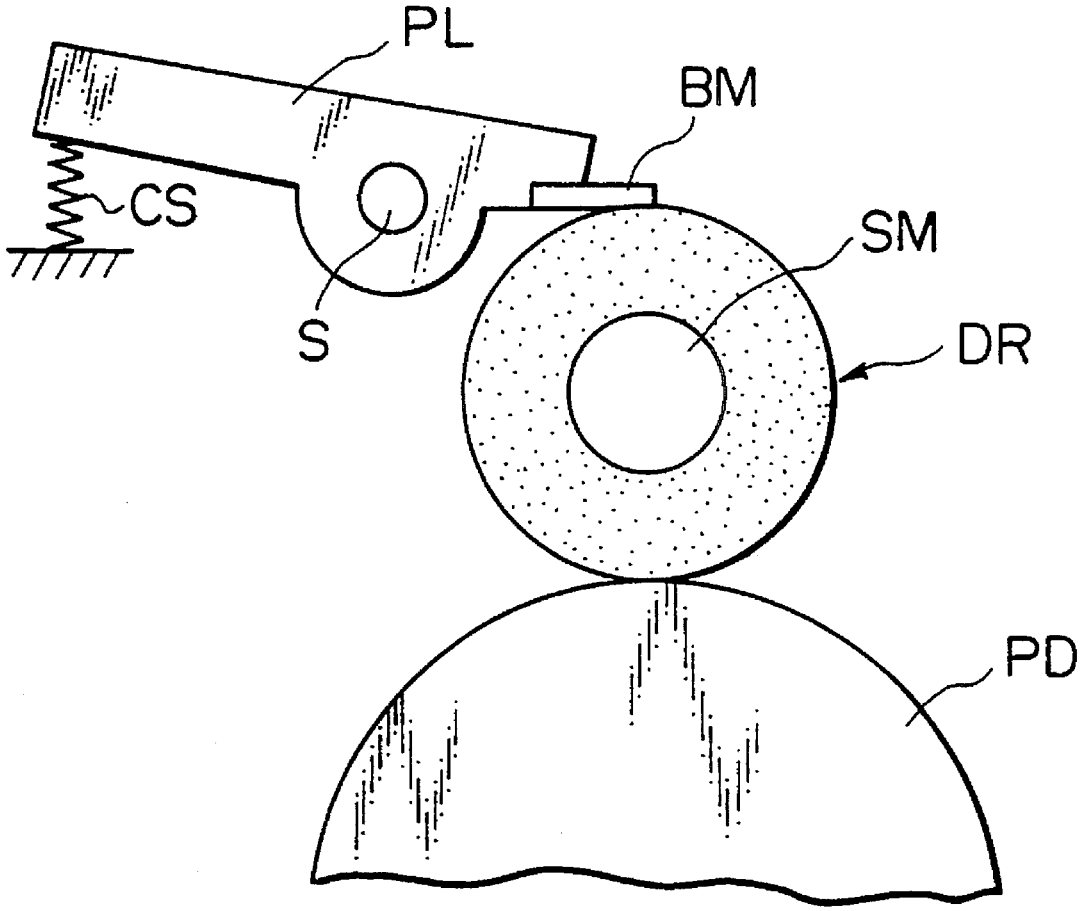
FIG. 26 shows a conventional arrangement including a conductive foam rubber developing roller resiliently pressed against a photosensitive drum, and a metal blade member resiliently pressed against the developing roller for regulating the thickness of the developer entrained thereby.
Figure 27:
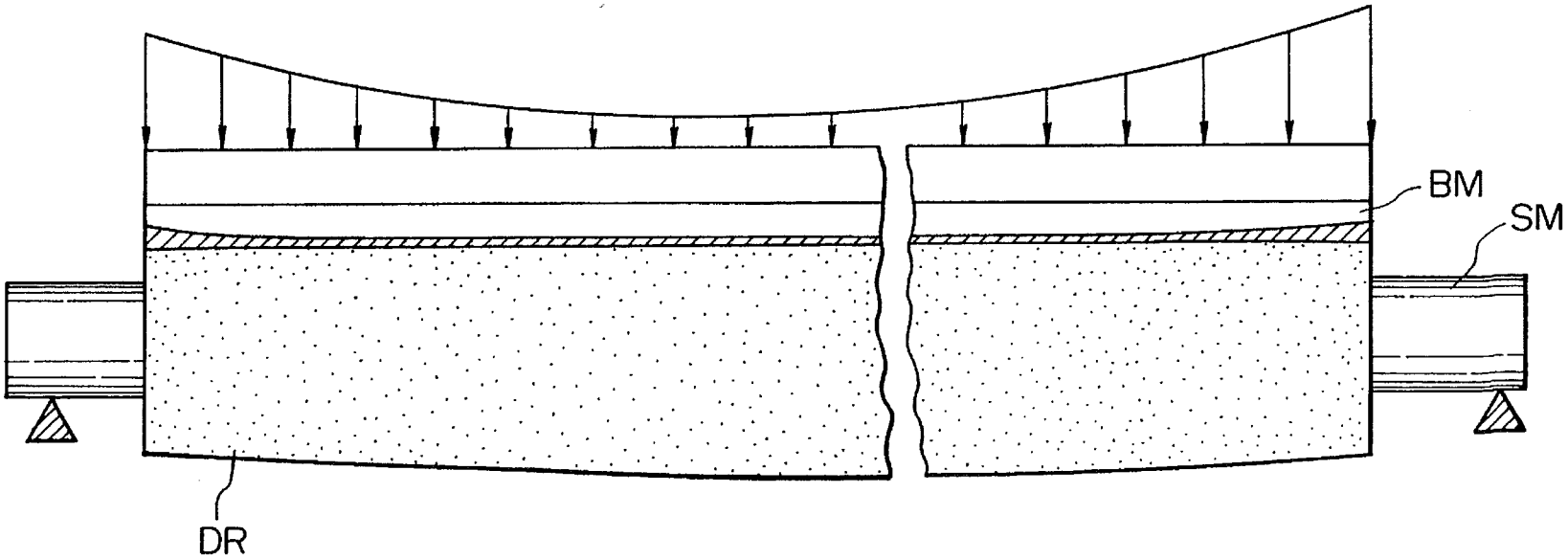
FIG. 27 is a schematic view showing the conductive foam rubber developing roller of FIG. 26 together with a distribution of pressure of the developing roller when exerting a pressure on the developing roller by a blame member.
Figure 28:
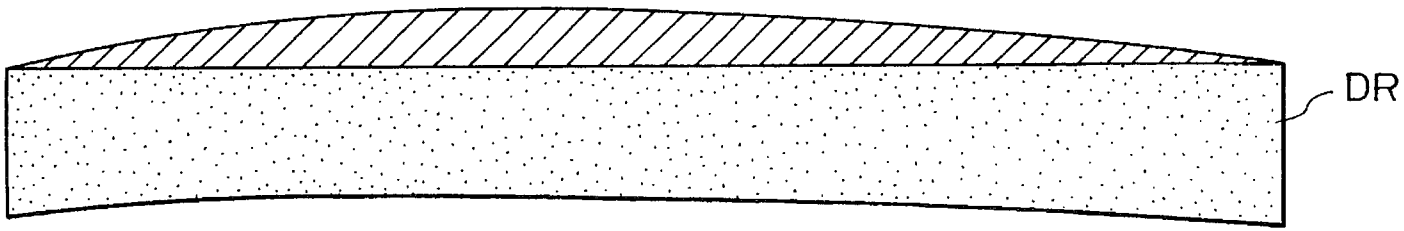
FIG. 28 iS a partial side view showing the conductive foam rubber developing roller together with a developer entrained thereby and regulated by the blade member shown in FIGS. 26 and 27.
Figure 29:
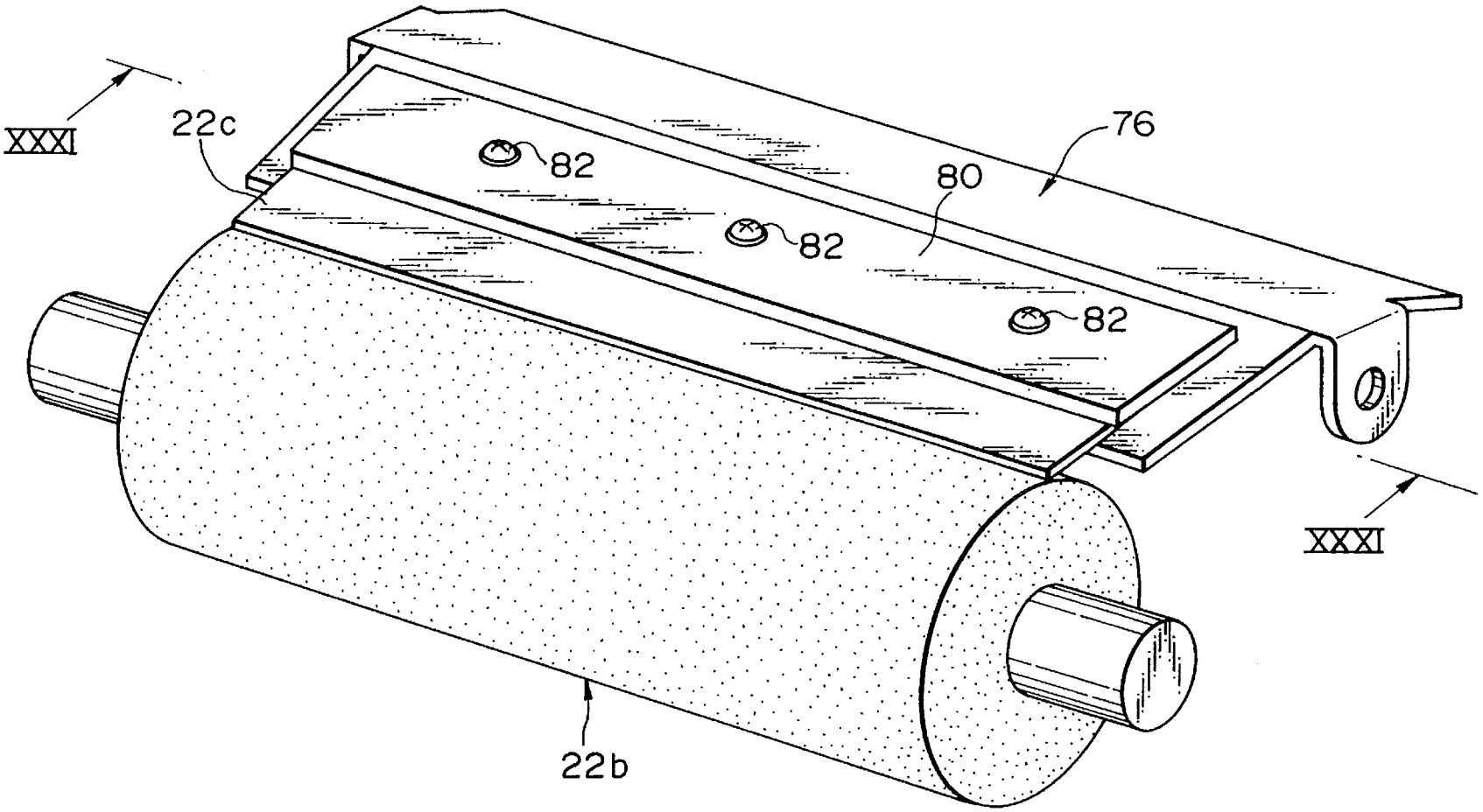
FIG. 29 is a perspective view of a partial arrangement of a developing device according to the present invention.
Figure 30:
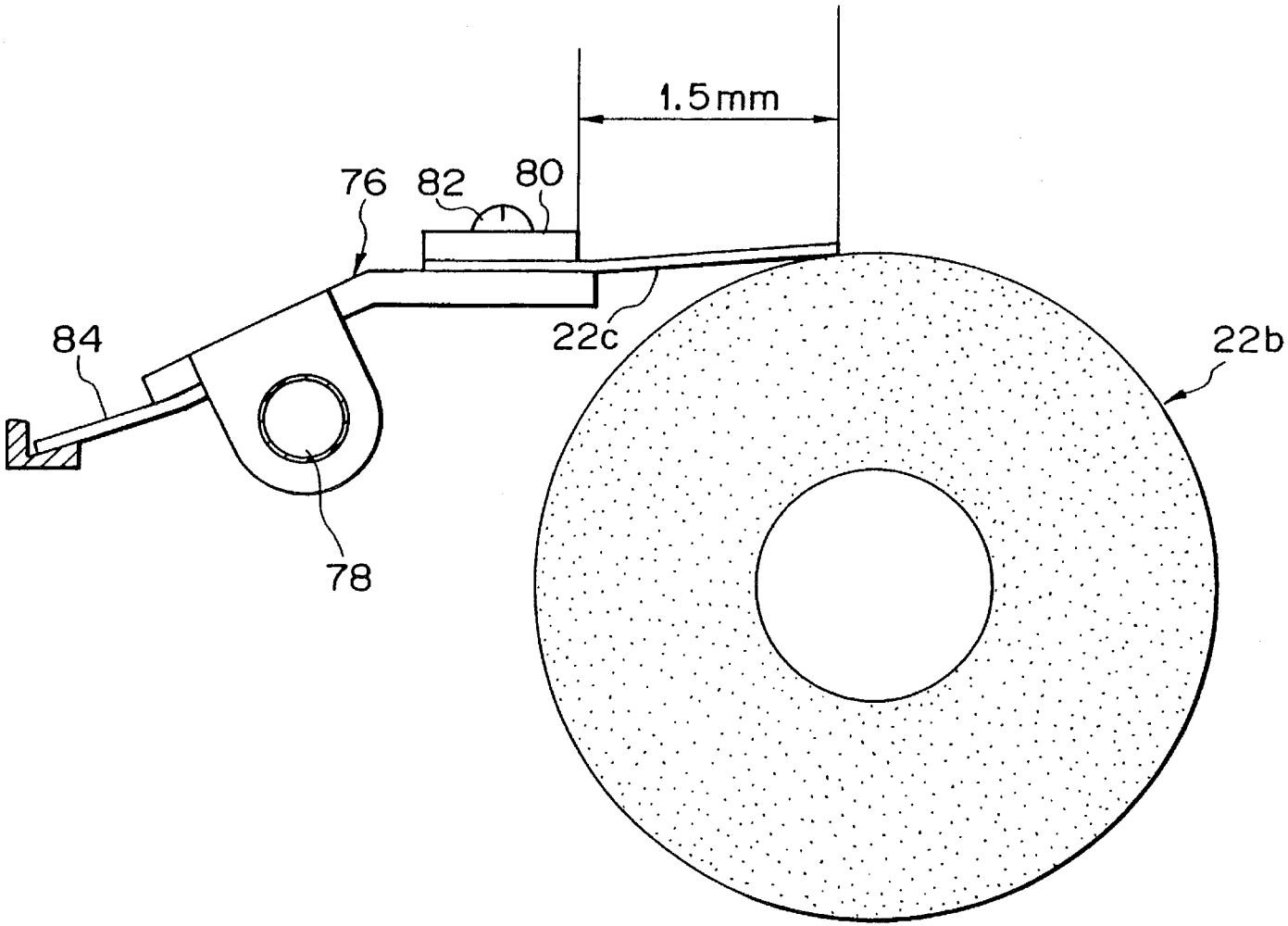
FIG. 30 is an end view of the arrangement shown in FIG. 29.

FIG. 26 shows a conventional arrangement including a conductive foam rubber developing roller DR resiliently pressed against a photosensitive drum PD and a metal blade member BM resiliently pressed against the developing roller DR. A plate-like lever PL is disposed adjacent the developing roller DR and is rotatably mounted on a shaft S. The metal blade member BM is fixed to an arm of a plate-like lever PL, and the other arm of thereof is resiliently biased by a coil spring CS so that the metal blade member BM is pressed against the developing roller DR. Accordingly, a thickness of the developer entrained by the developing roller DR should be uniformly regulated by the blade member BM. Nevertheless, the developer thickness cannot be made uniform for the reason discussed below:

As shown in FIG. 27, the shaft member SM of the developing roller DR is supported at the ends thereof, and thus the a shaft member SM of the developing roller DR may be resiliently deformed or bent at a very small angle when the blade member BM is pressed against the developing roller at a given pressure for the regulation of the developer thickness, so that the developing roller DR cannot be subjected to a uniform distribution of pressure by the blame member BM, as represented by a plurality of arrows in FIG. 27. Namely, a pressure exerted on a central zone of the developing roller DR is smaller than that exerted on the end zones thereof. Accordingly, the end portions of the blade member BM are pressed deeply into the developing roller DR, but the central portion of the blade member BM is not pressed deeply into the developing roller DR, as represent&d by a hatching zone in FIG. 27. Thus, the thickness of the developer regulated by the blade member BM, which is represented by a hatching zone in FIG. 28, cannot be made uniform by the blade member A third aspect of the present invention is directed to a developing device 22 constituted such that the regulation of the developer thickness can be made uniform by the blade member **22*c* as much as possible. The developing device 22 includes a plate-like lever member 76 as shown in FIGS. 29 and 30, which is rotatably mounted on a shaft 78 (FIG. 30) supported by the side walls of the developer vessel 22*a*. The blade member 22*c* is held between a fitting plate 80 and an arm portion of the plate-like lever member 76, and is securely attached thereto by screws 82. The other arm portion of the plate-like lever member 76 is resiliently biased by a pair of leaf springs 84 (FIG. 30), so that the blade member 22*c* is resiliently pressed against the developing roller 22*b***.

Figure 31:
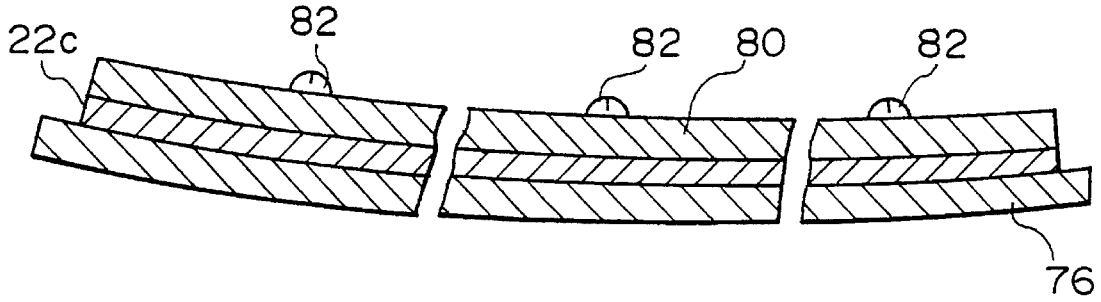
FIG. 31 is a cross-sectional view taken along a XXXI—XXXI line of FIG. 29.
Figure 32:
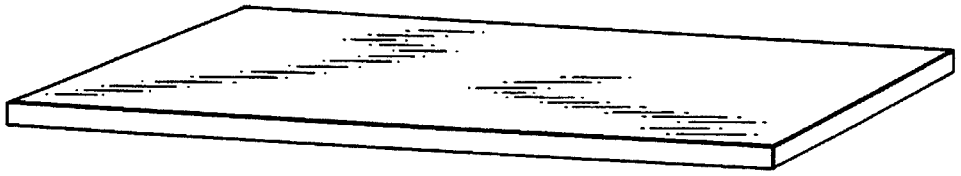
FIG. 32 is a perspective view showing a flat plate work for producing a plate-like lever member of the arrangement shown in FIGS. 29 and 30.
Figure 33:
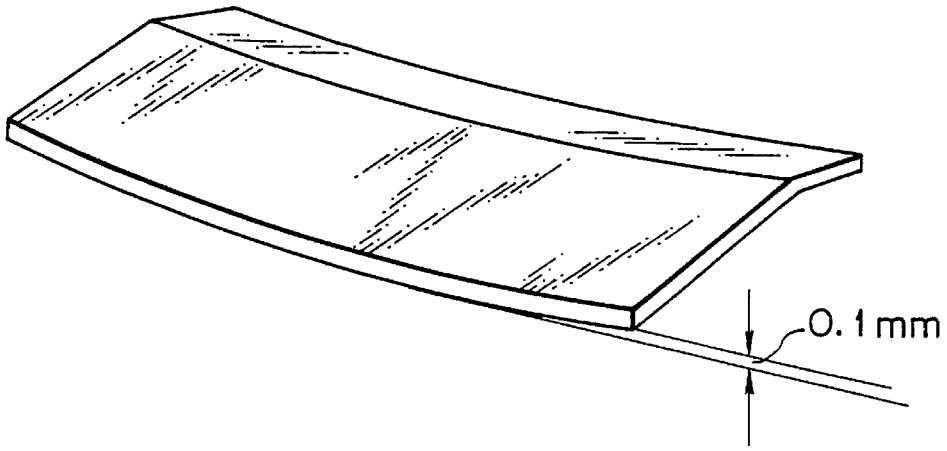
FIG. 33 is a perspective view showing a shape obtained by pressing the-flat plate work shown in FIG. 32.
Figure 34:
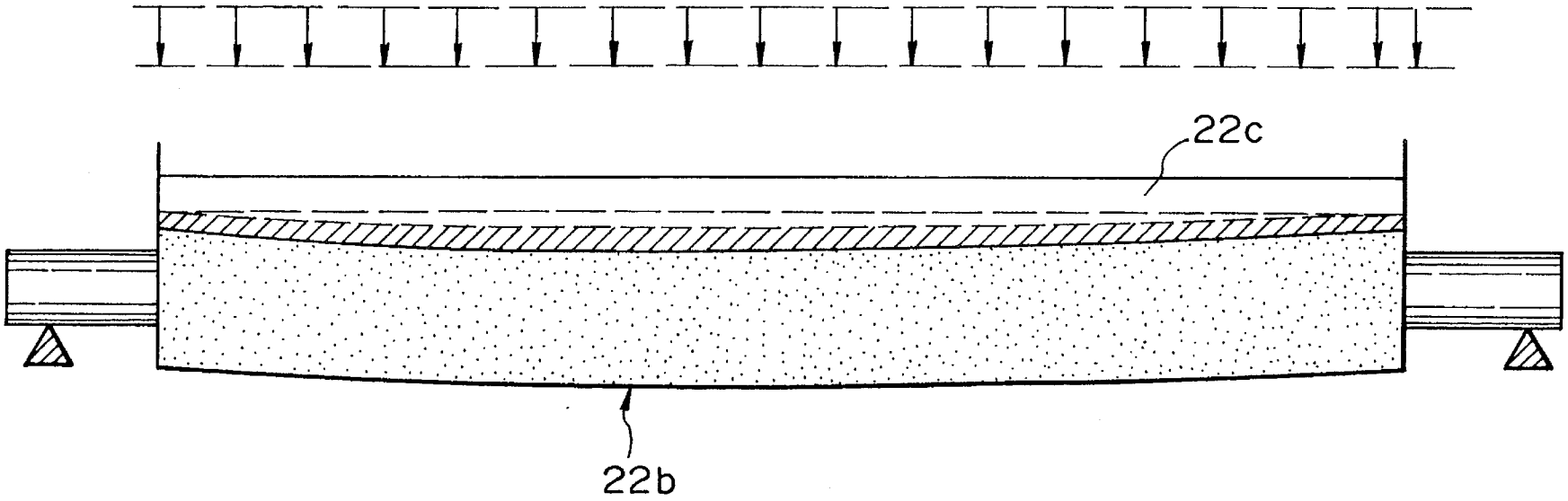
FIG. 34 is a side view showing a conductive foam rubber developing roller of the arrangement shown in FIGS. 29 and 30 together with a distribution of pressure of the developing roller when exerting a pressure on the developing roller by a curved blame member of said arrangment.

In the arrangement as shown in FIGS. 29 and 30, the developing roller **22*b* has a diameter of 20 mm, and a shaft member 22*b*' thereof has a diameter of 12 mm. Also, the developing roller 22*b* has an effective printing width of 300 mm, and a conductive foam rubber roller element is formed of a foam polyurethane material. The blade member 22*c* is formed of a stainless steel sheet having a thickness of 0.1 mm According to the third aspect of the present invention, the plate-like lever member 76 is curved as exaggeratively shown in FIG. 31. The lever member 76 is obtained from a flat plate work as shown in FIG. 32 by pressing it into a shape as shown in FIG. 33. A degree of the curvature of the lever member 76 is about 0.1 mm, as shown in FIG. 33. Accordingly, when the blade member 22***c* is securely held between the fitting plate 80 and the arm portion of the plate-like lever member 76 by the screws 82, it has the same curvature as the lever member 76. As apparent from FIGS. 29 to 31, the convex side of the curved blade member 22*c* is tangentially pressed against the developing roller 22*b*. In this case, the blade member 22*c* is extended from the fitting plate 80 by a length of about 1.5 mm, and is pressed against by the pair of leaf spring 84*s* at a linear pressure of from 25 to 50 g/cm. With the requirements as mentioned above, a pressure exerted on the central zone of the developing roller 22*b* becomes larger in comparison with that exerted on the end zones thereof. Accordingly, the blade member 22*c* can be uniformly pushed into the developing roller 22*b*, as represented by a hatching zone in FIG. 34, and thus the developing roller 22*b* can be subjected to a uniform distribution of pressure by the blade member 22*c*, as represented by a plurality of arrows in FIG. 34.

Figure 35:
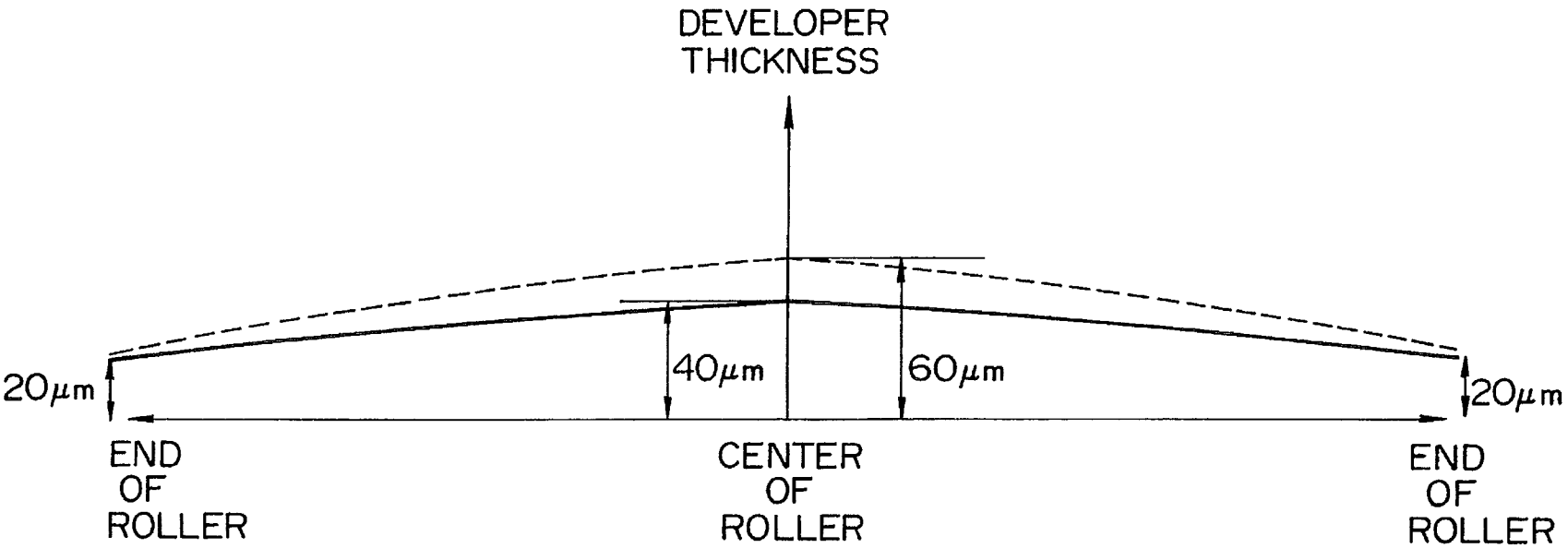
FIG. 35 is a graph showing a thickness of the developer regulated by the curved blade member of the arrangement shown in FIGS. 29 and 30.

In a graph of FIG. 35, the solid line represents the thickness of the developer regulated by the blade member 22*c*, and the broken line represents the thickness of the developer regulated by the blade member BM as shown in FIG. 26. As apparent from this graph, according to the present invention, the developer thickness can be made more uniform by the curved blade member 22*c*.

Figure 36:
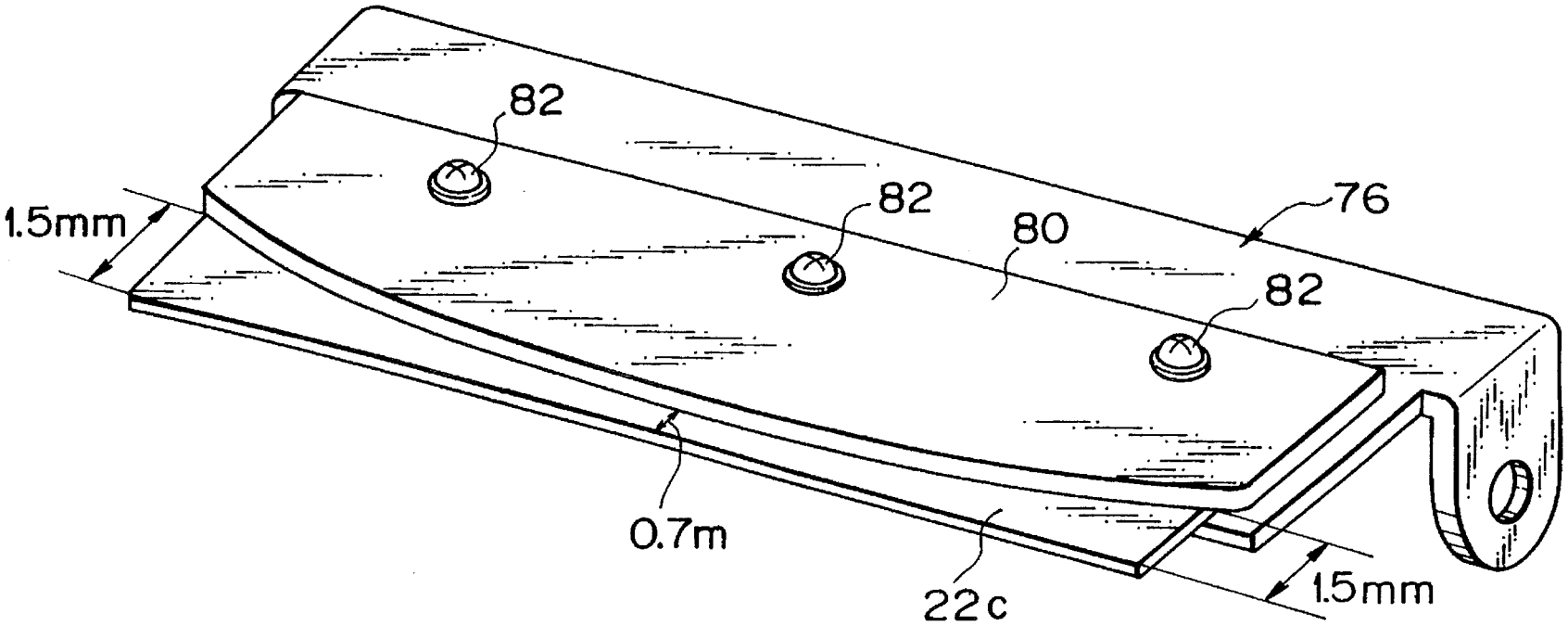
FIG. 36 is a perspective view of a partial arrangement of another type of developing device according to the present invention.
Figure 37:
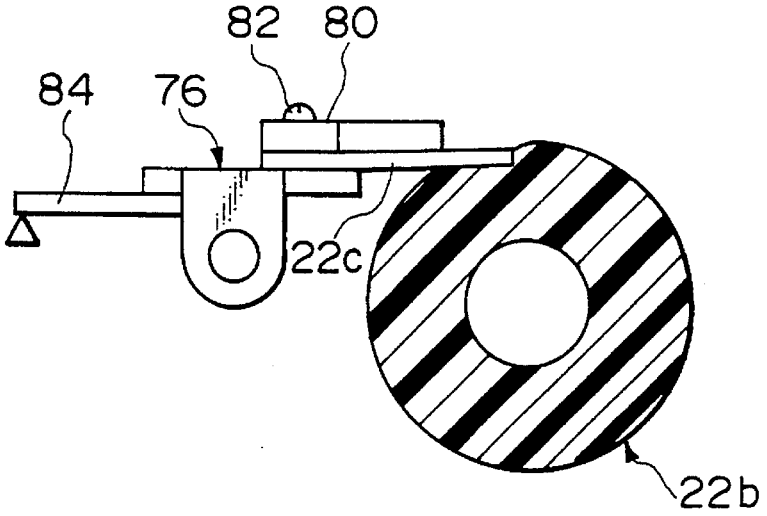
FIG. 37 is an end view showing the arrangement shown in FIG. 36, in which a conductive foam rubber developing roller is shown in a cross-sectional view.
Figure 38:
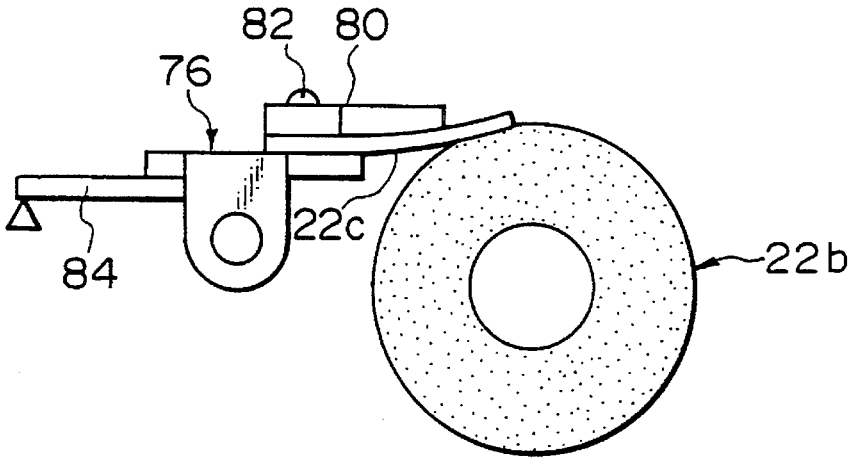
FIG. 38 is an end view similar to FIG. 37, showing the conductive foam rubber developing roller in and end view.

FIGS. 36 to 38 show another embodiment according to the third aspect of the present invention. Similar to the embodiment as mentioned above, the blade member 22*c* is securely held between the fitting plate 80 and the arm portion of the plate-like lever member 76 by the screws 82, and the other arm portion of the plate-like lever member 76 is resiliently biased by the leaf springs 84 (FIGS. 37 and 38), so that the blade member 22*c* is resiliently pressed against the developing roller 22*b*. In this embodiment, the blade member 22*c* is kept flat between the fitting plate 80 and the arm portion of the plate-like lever member 76, but the fitting plate 80 has a convex profile such that a length of the portion of the blade member 22*c*, which is extended from the fitting plate 80, is varied in accordance with the convex profile thereof. Namely, the blade member 22*c* is extended from the fitting plate 80 by a length of about 0.7 mm at the center thereof, and is extended from the fitting plate 80 by a length of 1.5 mm at the end thereof, as shown in FIG. 36. Furthermore, the developing roller 22*b* and the blade member 22*c* have the same particulars as mentioned above. The blade member 22*c* is pushed more deeply into the developing roller 22*b* at the center thereof, as shown in FIG. 37, and is not pushed deeply into the developing roller 22*b* at the ends thereof. The thickness of the developer regulated by the flat blade member 22*c* exhibits substantially the same characteristic as shown by the solid line in the FIG. 35.

Figure 39:
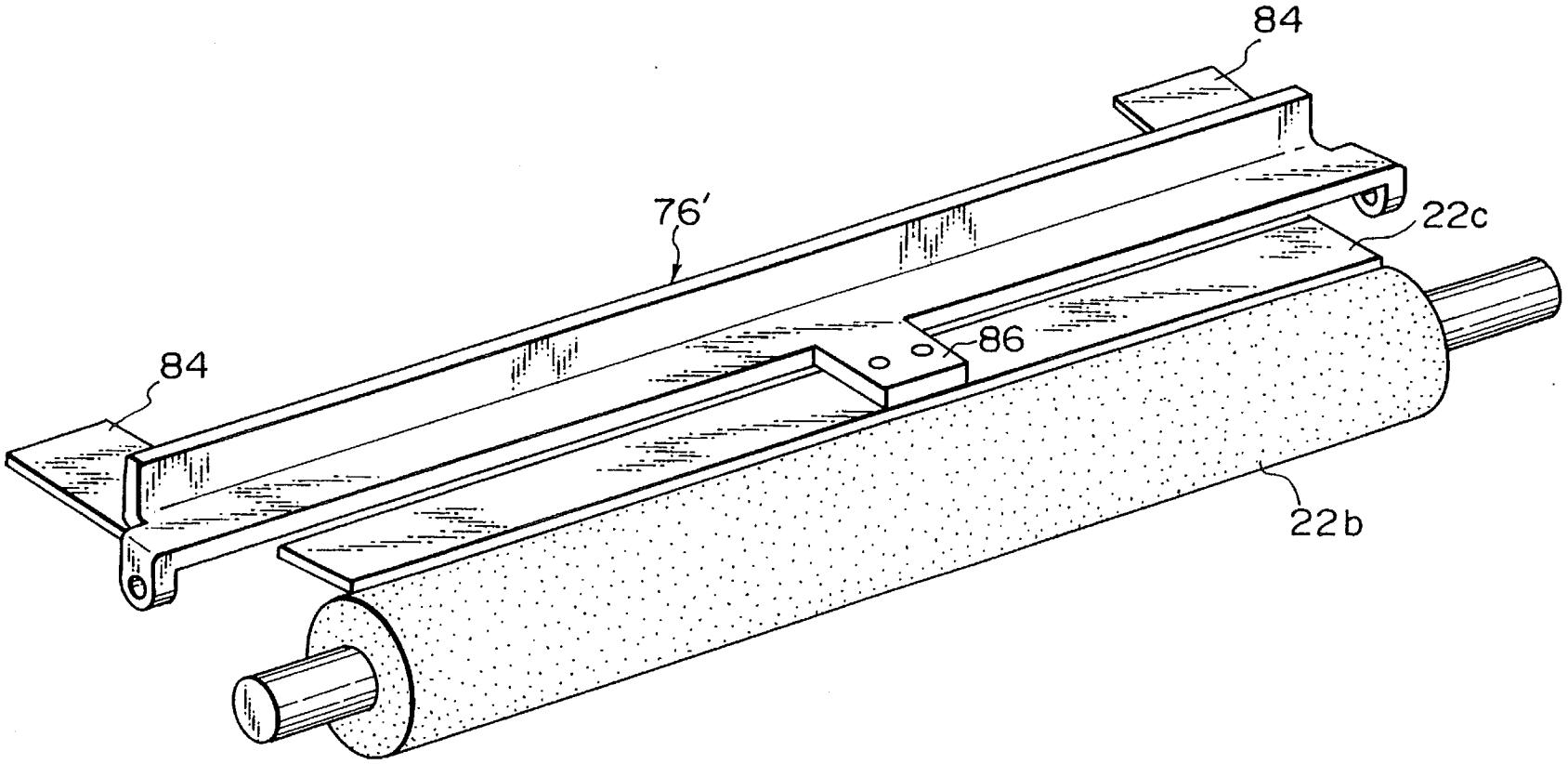
FIG. 39 is a perspective view of a partial arrangement of yet another type developing device according to the present invention.
Figure 40:
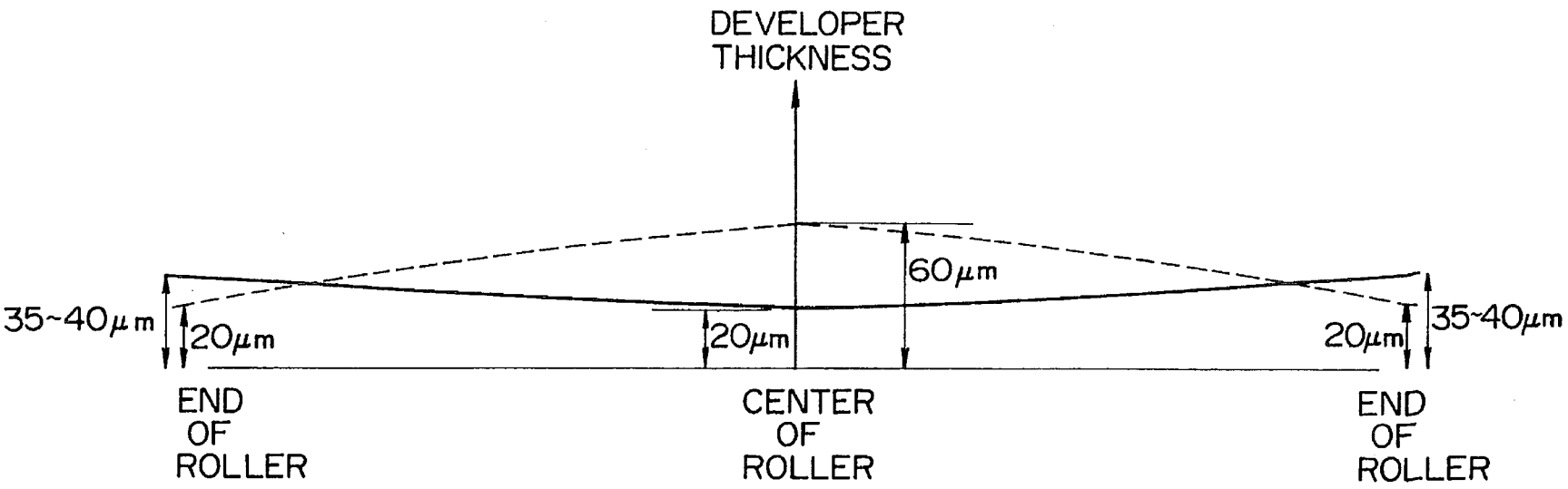
FIG. 40 is a graph showing a thickness of the developer regulated by the blade member of the arrangement shown in FIG. 39.

FIG. 39 shows yet another embodiment according to the third aspect of the present invention. In this embodiment, the developing device 22 includes a plate-like lever member 76' which is rotatably supported by the side walls of the developer vessel 22*a*. The blade member 22*c* is securely attached to a tongue-like member 86 projected from the center of the lever member 76', and the lever member 76' is resiliently biased by the leaf springs 84 so that the blade member 22*c* is resiliently pressed against the developing roller 22*b*. In this embodiment, the blade member 22*c* is formed of a cold-rolled steel having a thickness of 3 mm, and may have a width of from 3.5 to 4.0 mm. A pressure of 1.8 kg is exerted on the developing roller 22*b* by the leaf springs 84 through the intermediary of the tongue-like member 86 and the blade member 22*c*. The thickness of the developer regulated by the blade member 22*c* has a characteristic shown by a solid line in a graph of FIG. 40. Note, in this graph, the broken line represents the thickness of the developer regulated by the blade member BM as shown in FIG. 26.

Finally, it will be understood by those skilled in the art that the foregoing description is of preferred embodiments of the present invention, and that various changes and modifications can be made without departing from the spirit and scope thereof.

We claim:

1. A conductive rubber roller used in an image formation apparatus wherein an electrostatic latent image formed on an image carrying body is electrostatically developed with a toner developer, and is electrostatically transferred from said image carrying body to a recording medium, which conductive rubber roller comprises:

a conductive tubular rubber roller element having an outer thicker portion including a given amount of conductive filler dispersed therein, and an inner skin layer defining a central bore thereof and exhibiting an electrical resistivity considerably higher than that of said outer thicker portion for lack of conductive filler;

a conductive shaft member fixedly inserted into the central bore of said conductive tubular rubber roller element; and an electrical contact establishing means provided between said conductive tubular rubber roller element and said conductive shaft member for establishing a sufficient electrical contact therebetween, said electrical contact establishing means including two conductive plate members mounted on said conductive shaft member and adhered to end faces of said conductive tubular rubber roller element by a conductive adhesive.

2. A conductive rubber roller as set forth in claim 1, wherein the outer thicker portion of said conductive tubular rubber roller element has an open-cell foam structure, and the inner skin layer is formed as a solid skin layer.

3. A conductive rubber roller as set forth in claim 1, wherein said conductive rubber roller is used in said image formation apparatus as a developing roller for entraining and carrying the toner developer to said image carrying body for development of an electrostatic latent image formed thereon.

4. A conductive rubber roller as set forth in claim 1, wherein said conductive rubber roller is used in said image formation apparatus as a transferring roller for transferring a developed image from said image carrying body to a recording medium.

5. A conductive rubber roller used in an image formation apparatus wherein an electrostatic latent image formed on an image carrying body is electrostatically developed with a toner developer, and is electrostatically transferred from said image carrying body to a recording medium, which conductive rubber roller comprises:

a conductive tubular rubber roller element having an outer thicker portion including a given amount of conductive filler dispersed therein, and an inner skin layer defining a central bore thereof and exhibiting an electric resistivity considerably higher than that of said outer thicker portion for lack of conductive filler;

a conductive shaft member fixedly inserted into the central bore of said conductive tubular rubber roller element; and an electrical contact establishing means provided between said conductive tubular rubber roller element and said conductive shaft member for establishing sufficient electrical contact therebetween, said electrical contact establishing means including two conductive plate members mounted on said conductive shaft member and adhered to end faces of said conductive tubular rubber roller element by thermally fusing a material of the outer thicker portion of said conductive tubular rubber roller element at the end faces thereof.

6. A conductive rubber roller as set forth in claim 5, wherein the outer thicker portion of said conductive tubular rubber roller element has an open-cell foam structure, and the inner skin layer is formed as a solid skin layer.

7. A conductive rubber roller as set forth in claim 5, wherein said conductive rubber roller is used in said image formation apparatus as a developing roller for entraining and carrying the toner developer to said image carrying body for development of an electrostatic latent image formed thereon.

8. A conductive rubber roller as set forth in claim 5, wherein said conductive rubber roller is used in said image formation apparatus as a transferring roller for transferring a developed image from said image carrying body to a recording medium.

9. A conductive rubber roller used in an image formation apparatus wherein an electrostatic latent image formed on an image carrying body is electrostatically developed with a toner developer, and is electrostatically transferred from said image carrying body to a recording medium, which conductive rubber roller comprises:

a conductive tubular rubber roller element having an outer thicker portion including a given amount of conductive filler dispersed therein, and an inner skin layer defining a central bore thereof and exhibiting an electric resistivity considerably higher than that of said outer thicker portion for lack of conductive filler;

a conductive shaft member fixedly inserted into the central bore of said conductive tubular rubber roller element; and an electrical contact establishing means provided between said conductive tubular rubber roller element and said conductive shaft member for establishing sufficient electrical contact therebetween, said electrical contact establishing means including an at least partial thermal fusing of the inner skin layer of said conductive tubular rubber roller element.

10. A conductive rubber roller-as sot forth in claim 9, wherein the outer thicker portion of said conductive tubular rubber roller element has an open-cell foam structure, and the inner skin layer is formed as a solid skin layer.

11. A conductive rubber roller as set forth in claim 9, wherein said conductive rubber roller is used in said image formation apparatus as a developing roller for entraining and carrying the toner developer to said image carrying body for development of an electrostatic latent image formed thereon.

12. A conductive rubber roller as set forth in claim 9, wherein said conductive rubber roller is used in said image formation apparatus as a transferring roller for transferring a developed image from said image carrying body to a recording medium.

13. A conductive rubber roller used in an image formation apparatus wherein an electrostatic latent image formed on an image carrying body is electrostatically developed with a toner developer, and is electrostatically transferred from said image carrying body to a recording medium, which conductive rubber roller comprises:

a conductive tubular rubber roller element having an outer thicker portion including a given amount of conductive filler dispersed therein, and an inner skin layer defining a central bore thereof and exhibiting an electric resistivity considerably higher than that of said outer thicker portion for lack of conductive filler;

a conductive shaft member fixedly inserted into the central bore of said conductive tubular rubber roller element; and an electrical contact establishing means provided between said conductive tubular rubber roller element and said conductive shaft member for establishing sufficient electrical contact therebetween, said electrical contact establishing means including an electrical insulation-breakage of the inner skin layer of said conductive tubular rubber roller element.

14. A conductive rubber roller as set forth in claim 13, wherein the outer thicker portion of said conductive tubular rubber roller element has an open-cell foam structure, and the inner skin layer is formed as a solid skin layer.

15. A conductive rubber roller as set forth in claim 13, wherein said conductive rubber roller is used in said image formation apparatus as a developing roller for entraining and carrying the toner developer to said image carrying body for development of an electrostatic latent image formed thereon.

16. A conductive rubber roller as set forth in claim 13, wherein said conductive rubber roller is used in said image formation apparatus as a transferring roller for transferring a developed image from said image carrying body to a recording medium.

17. An electrophotographic recording apparatus comprising:

an electrostatic latent image carrying body means;

a developing roller means for entraining the developer to bring an electrostatically-charged toner developer to said electrostatic latent image carrying body means for development of an electrostatic latent image with the toner developer; and a transfer roller means for electrostatically transferring a charged toner image developed by said developing roller means from said electrostatic latent image carrying body means to a recording medium such as a paper, wherein at least one of said developing roller means and said transfer roller means includes a conductive foam rubber roller which comprises:

a conductive tubular rubber roller element having an outer thicker portion including a given amount of conductive filler dispersed therein, and an inner skin layer defining a central bore thereof and exhibiting an electric resistivity considerably higher than that of said outer thicker portion for lack of conductive filler;

a conductive shaft member fixedly inserted into the central bore of said conductive tubular rubber roller element; and an electrical contact establishing means provided between said conductive tubular rubber roller element and said conductive shaft member for establishing sufficient electrical contact therebetween, said electrical contact establishing means including two conductive plate members mounted on said conductive shaft member and adhered to end faces of said conductive tubular rubber roller element by a conductive adhesive.

18. An electrophotographic recording apparatus comprising:

an electrostatic latent image carrying body means;

a developing roller means for entraining the developer to bring an electrostatically-charged toner developer to said electrostatic latent image carrying body means for development of an electrostatic latent image with the toner developer; and a transfer roller means for electrostatically transferring a charged toner image developed by said developing roller means from said electrostatic latent image carrying body means to a recording medium such as a paper, wherein at least one of said developing roller means and said transfer roller means includes a conductive foam rubber roller which comprises:

a conductive tubular rubber roller element having an outer thicker portion including a given amount of conductive filler dispersed therein, and an inner skin layer defining a central bore thereof and exhibiting an electric resistivity considerably higher than that of said outer thicker portion for lack of conductive filler;

a conductive shaft member fixedly inserted into the central bore of said conductive tubular rubber roller element; and an electrical contact establishing means provided between said conductive tubular rubber roller element and said conductive shaft member for establishing sufficient electrical contact therebetween, said electrical contact establishing means including two conductive plate members mounted on said conductive shaft member and adhered to end faces of said conductive tubular rubber roller element by thermally fusing a material of the outer thicker portion of said conductive tubular rubber roller element at the end faces thereof.

19. An electrophotographic recording apparatus comprising:

an electrostatic latent image carrying body means;

a developing roller means for entraining the developer to bring an electrostatically-charged toner developer to said electrostatic latent image carrying body means for development of an electrostatic latent image with the toner developer; and a transfer roller means for electrostatically transferring a charged toner image developed by said developing roller means from said electrostatic latent image carrying body means to a recording medium such as a paper, wherein at least one of said developing roller means and said transfer roller means includes a conductive foam rubber roller which comprises:

a conductive tubular rubber roller element having an outer thicker portion including a given amount of conductive filler dispersed therein, and an inner skin layer defining a central bore thereof and exhibiting an electric resistivity considerably higher than that of said outer thicker portion for lack of conductive filler;

a conductive shaft member fixedly inserted into the central bore of said conductive tubular rubber roller element; and an electrical contact establishing means provided between said conductive tubular rubber roller element and said conductive shaft member for establishing sufficient electrical contact therebetween, said electrical contact establishing means including an at least partial thermal fusing of the inner skin layer of said conductive tubular rubber roller element.

20. An electrophotographic recording apparatus comprising:

an electrostatic latent image carrying body means;

a developing roller means for entraining the developer to bring an electrostatically-charged toner developer to said electrostatic latent image carrying body means for development of an electrostatic latent image with the toner developer; and a transfer roller means for electrostatically transferring a charged toner image developed by said developing roller means from said electrostatic latent image carrying body means to a recording medium such as a paper, wherein at least one of said developing roller means and said transfer roller means includes a conductive foam rubber roller which comprises:

a conductive tubular rubber roller element having an outer thicker portion including a given amount of conductive filler dispersed therein, and an inner skin layer defining a central bore thereof and exhibiting an electric resistivity considerably higher than that of said outer thicker portion for lack of conductive filler;

a conductive shaft member fixedly inserted into the central bore of said conductive tubular rubber roller element; and an electrical contact establishing means provided between said conductive tubular rubber roller element and said conductive shaft member for establishing sufficient electrical contact therebetween, said electrical contact establishing means including an electrical insulation-breakage of the inner skin layer of said conductive tubular rubber roller element.

21. A developing device using a non-magnetic type developer for developing an electrostatic latent image formed on an image carrying body, which device comprises:

developer carrying means resiliently pressed against the image carrying body and formed of a conductive open-cell foam rubber material so that pore openings appear on a surface of said developer carrying means to entrain and carry the developer to a surface of the image carrying body for development of the electrostatic latent image formed thereon, said developer carrying means being supplied with a developing bias voltage; and developer regulating means engaged with said developer carrying means for regulating a thickness of the developer entrained and carried thereby, wherein the developer is composed of a toner component having a given average diameter, and a resin powder component having a diameter of about three hundredths of the average diameter thereof, the toner component of which has a polarity opposite to that of an electric charge of the resin powder component generated by triboelectrification therebetween, wherein the pore openings of said developer carrying means have a diameter of from about two and a half to about four times the average diameter of the toner component of said developer, and wherein the polarity of the resin powder component is opposite to that of the developing bias voltage so that the toner component is electrostatically held in the pore openings through the intermediary of the reversely-charged resin powder component.

22. A developing device as set forth in claim 21, wherein said developer regulating means is formed of a conductive material, and is supplied with electrical energy to electrically charge the toner component of said developer at a given polarity by a charge-injection effect during the regulation of the thickness of the developer.

23. A developing device as set forth in claim 21, wherein the toner component of said developer is a polyester resin-based toner component, and the resin powder component is formed of a resin material selected from a group consisting of melamine resin, acrylic resin, and styrene acrylic resin.

24. A developing device as set forth in claim 21, wherein the conductive open-cell foam rubber material of said developer carrying means has a volume resistivity of from about $10^4$ Ω.cm to about $10^{10}$ Ω.cm.

25. A developing device as set forth in claim 24, wherein said developer carrying means comprises a developing roller means formed of a conductive open-cell foam rubber material selected from a group consisting of a conductive open-cell foam polyurethane rubber material, a conductive open-cell foam urethane rubber material, and a conductive open-cell foam silicone rubber material.

26. A developing device using a non-magnetic type developer for developing an electrostatic latent image formed on an image carrying body, which device comprises:

developer carrying means resiliently pressed against the image carrying body and formed of a conductive open-cell foam rubber material so that pore openings appear on a surface of said developer carrying means to entrain and carry the developer to a surface of the image carrying body for development of the electrostatic latent image formed thereon; and developer regulating means engaged with said developer carrying means for regulating a thickness of the developer entrained and carried thereby, wherein the developer is composed of a toner component and a resin powder component, the toner component of which has a polarity opposite to that of an electric charge of the resin powder component generated by triboelectrification therebetween, wherein the pore openings of said developer carrying means have a diameter of from about two and a half to about four times an average diameter of the toner component of said developer.

27. A developing device using a non-magnetic type developer for developing an electrostatic latent image formed on an image carrying body, which device comprises:

developer carrying means resiliently pressed against the image carrying body and formed of a conductive open-cell foam rubber material so that pore openings appear on a surface of said developer carrying means to entrain and carry the developer to a surface of the image carrying body for development of the electrostatic latent image formed thereon; and developer regulating means engaged with said developer carrying means for regulating a thickness of the developer entrained and carried thereby, wherein the developer is composed of a toner component and a resin powder component, the toner component of which has a polarity opposite to that of an electric charge of the resin powder component generated by triboelectrification therebetween, wherein the pore openings of said developer carrying means have a diameter of from about two and a half to about four times an average diameter of the toner component of the developer, and wherein said developer carrying means includes:

a conductive tubular foam rubber roller element having an outer thicker portion including a given amount of conductive filler dispersed therein, and an inner solid skin layer defining a central bore thereof and exhibiting an electrical resistivity considerably higher than that of said outer thicker portion for lack of conductive filler;

a conductive shaft member fixedly inserted into the central bore of said conductive tubular rubber roller element; and an electrical contact establishing means provided between said conductive tubular rubber roller element and said conductive shaft member for establishing a sufficient electric contact therebetween.

28. A developing device as set forth in claim 27, wherein said electrical contact establishing means including two conductive plate members mounted on said conductive shaft member and adhered to end faces of said conductive tubular rubber roller element by a conductive adhesive.

29. A developing device as set forth in claim 27, wherein said electrical contact establishing means including two conductive plate members mounted on said conductive shaft member and adhered to end faces of said conductive tubular rubber roller element by thermally fusing a material of the outer thicker portion of said conductive tubular foam rubber roller element at the end faces thereof.

30. A developing device as set forth in claim 27, wherein said electrical contact establishing means including an at least partial thermal fusing of the inner skin layer of said conductive tubular rubber roller element.

31. A developing device as set forth in claim 27, wherein said electrical contact establishing means including an electrical insulation-breakage of the inner skin layer of said conductive tubular rubber roller element.

32. An image formation apparatus comprising:

image carrying means for carrying an electrostatic latent image formed thereon; and developing means for developing the electrostatic latent image of said image carrying means with a non-magnetic type developer, said developing means including a developer carrying means resiliently pressed against said image carrying means and formed of a conductive open-cell foam rubber material so that pore openings appear on a surface thereof to entrain and carry the developer to a surface of said image carrying means for development of the electrostatic latent image formed thereon, said developer carrying means being supplied with a developing bias voltage, and a developer regulating means engaged with said developer carrying means for regulating a thickness of the developer entrained and carried thereby, wherein the developer is composed of a toner component having a given average diameter, and a resin powder component having a diameter less than the average diameter thereof, the toner component of which has a polarity opposite to that of an electric charge of the resin powder component generated by triboelectrification therebetween, and wherein the polarity of the resin powder component is opposite to that of the developing bias voltage so that the toner component is electrostatically held in the pore openings through the intermediary of the reversely-charged resin powder component.

33. An image formation apparatus as set forth in claim 32, further comprising a transferring means for transferring a developed image from said image carrying means to a recording medium, wherein an efficiency of the transfer of the developed image to the recording medium is increased due to the resin powder component included in the developed image.

34. An image formation apparatus as set forth in claim 32, wherein said developer regulating means is formed of a conductive material, and is supplied with electrical energy to electrically charge the toner component of said developer at a given polarity by a charge-injection effect during the regulation of the thickness of the developer.

35. An image formation apparatus as set forth in claim 32, wherein the pore openings of said developer carrying means have a diameter of from about two times to about four times an average diameter of the toner component of said developer.

36. An image formation apparatus as set forth in claim 32, wherein the toner component of said developer is a polyester resin-based toner component, and the resin powder component is formed of a resin material selected from a group consisting of melamine resin, acrylic resin, and systems acrylic resin.

37. An image formation apparatus as set forth in claim 32, wherein the conductive open-cell foam rubber material of said developer carrying means has a volume resistivity of from about $10^4$ Ω.cm to about $10^{10}$ Ω.cm.

38. A developing device as set forth in claim 37, wherein said developer carrying means comprises a developing roller means formed of a conductive open-cell foam rubber material selected from a group consisting of a conductive open-cell foam-polyurethane rubber material, a conductive open-cell foam urethane rubber material, and a conductive open-cell foam silicone rubber material.

39. A developing device using a non-magnetic type developer for developing an electrostatic latent image formed on an image carrying body, which device comprises:

a developer carrying roller resiliently pressed against the image carrying body and formed of a conductive open-cell foam rubber material so that pore openings appear on a surface of said developer carrying means to entrain and carry the developer to a surface of the image carrying body for development of the electrostatic latent image formed thereon;

a shaft member for holding said developer carrying roller, said shaft member having a longitudinal axis;

a thin metal blade member pressed against said developer carrying roller, said thin metal blade member extending along the longitudinal axis of said shaft member to regulate a thickness of the developer entrained and carried thereby; and a holder for holding said thin metal blade member so as to press the same against said developer carrying roller, said holder being constituted such that a larger pressure is applied to said thin metal blade member at a center of said shaft member in the longitudinal axis thereof, for compensating for a resilient deformation of the shaft member of said developer carrying roller, which is caused when pressing said thin metal blade member against said developer carrying roller.

40. A developing device as set forth in claim 39, wherein said holder holds said thin metal blade member so as to give the same a curvature which is defined such that said developer carrying roller can be subjected to a uniform distribution of pressure by said thin metal blade member to make the thickness of the developer, regulated by said developer regulating means, uniform.

41. A developing device as set forth in claim 39, wherein said holder includes a fitting plate member for rigidly supporting a part of said thin metal blade member, and said fitting plate member has a convex profile which is defined such that said developer carrying roller can be subjected to a uniform distribution of pressure by said thin metal blade member to make the thickness of the developer, regulated by said developer regulating means, uniform.

42. A developing device as set forth in claim 39, wherein said holder has a central member projected from a center thereof, and said thin metal blade member is attached to said central member such that said developer carrying roller can be subjected to a uniform distribution of pressure by said thin metal blade member to make the thickness of the developer, regulated by said developer regulating means, uniform.

43. A developing device using a non-magnetic type developer for developing an electrostatic latent image formed on an image carrying body, which device comprises:

a developer carrying roller resiliently pressed against the image carrying body and formed of a conductive open-cell foam rubber material so that pore openings appear on a surface of said developer carrying means to entrain and carry the developer to a surface of the image carrying body for development of the electrostatic latent image formed thereon; and a developer regulating means including a thin metal blade member pressed against said developer carrying roller means for regulating a thickness of the developer entrained and carried thereby, wherein said developer regulating means further includes compensating means for compensating for a resilient deformation of a shaft member of said developer carrying roller means, which is caused when pressing said thin metal blade member against said developer carrying roller means, whereby the thickness of the developer regulated by said developer regulating means can be made substantially uniform, and wherein said developer carrying roller means includes:

a conductive tubular foam rubber roller element having an outer thicker portion including a given amount of conductive filler dispersed therein, and an inner solid skin layer defining a central bore thereof and exhibiting an electrical resistivity considerably higher than that of said outer thicker portion for lack of conductive filler;

a conductive shaft member fixedly inserted into the central bore of said conductive tubular rubber roller element; and an electrical contact establishing means provided between said conductive tubular rubber roller element and said conductive shaft member for establishing a sufficient element contact therebetween.

44. A developing device as set forth in claim 43, wherein said developer is composed of a toner component and a resin powder component, one component of which has a polarity opposite to that of-an electric charge of the other component generated by triboelectrification therebetween.

45. A developing device as set forth in claim 43, wherein said electrical contact establishing means including two conductive plate members mounted on said conductive shaft member and adhered to end faces of said conductive tubular rubber roller element by a conductive adhesive.

46. A developing device as set forth in claim 45, wherein said developer is composed of a toner component and a resin powder component, one component of which has a polarity opposite to that of an electric charge of the other component generated by triboelectrification therebetween.

47. A developing device as set forth in claim 43, wherein said electrical contact establishing means including two conductive plate members mounted on said conductive shaft member and adhered to end faces of said conductive tubular rubber roller element by thermally fusing a material of the outer thicker portion of said conductive tubular foam rubber roller element at the end faces thereof.

48. A developing device as set forth in claim 47, wherein said developer is composed of a toner component and a resin powder component, one component of which has a polarity opposite to that of an electric charge of the other component generated by triboelectrification therebetween.

49. A developing device as set forth in claim 43, wherein said electrical contact establishing means including an at least partial thermal fusing of the inner skin layer of said conductive tubular rubber roller element.

50. A developing device as set forth in claim 49, wherein said developer is composed of a toner component and a resin powder component, one component of which has a polarity opposite to that of an electric charge of the other component generated by triboelectrification therebetween.

51. A developing device as set forth in claim 43, wherein said electrical contact establishing means including an electrical insulation-breakage of the inner skin layer of said conductive tubular rubber roller element.

52. A developing device as set forth in claim 51, wherein said developer is composed of a toner component and a resin powder component, one component of which has a polarity opposite to that of an electric charge of the other component generated by triboelectrification therebetween.

* * * * *

UNITED STATES PATENT AND TRADEMARK OFFICE

CERTIFICATE OF CORRECTION

PATENT NO. : 5,489,974

DATED : February 6, 1996

INVENTOR(S) : Hideki KAMAJI, et al.

It is certified that error appears in the above-indentified patent and that said Letters Patent is hereby corrected as shown below:

Col. 1, line 6, after "continuation" delete ",".

Col. 2, line 8, change "Is" to --is--;
Col. 2, line 22, change "60-6946" to --60-6846--.

Col. 4, line 43, change "present-invention" to --present invention--.

Col. 5, line 44, change "ther-" to --there--;
Col. 5, line 45, change "ebetween." to --between.--.

Col. 7, line 66, change "lea" to --is a--.

Col. 8, line 46, change "blame" to --blade--;
Col. 8, line 47, change "iS" to --is--;
Col. 8, line 61, change "the-flat" to --the flat--;
Col. 8, line 67, change "blame" to --blade--.

Col. 9, line 11, change "and" to --an--;
Col. 9, line 23, change "FIGS." to --FIG.--.

Col. 10, line 16, change "Component," to --component,--;
Col. 10, line 51, change "age" to --image--.

Col. 12, line 14, change "she" to --the--.

Col. 13, line 10, change "54a" to --54b--.
Col. 13, line 19, change "rubber-roller" to --rubber roller--;

UNITED STATES PATENT AND TRADEMARK OFFICE

CERTIFICATE OF CORRECTION

PATENT NO. : 5,489,974

DATED : February 6, 1996

INVENTOR(S) : Hideki KAMAJI, et al.

It is certified that error appears in the above-indentified patent and that said Letters Patent is hereby corrected as shown below:

Col. 13, line 24, delete "be" (second occurrence).
Col. 13, line 63, change "$10^6$" to --$10^5$--.

Col. 14, line 25, change "54," to --54.--;
Col. 14, line 36, change "$10^6$" to --$10^5$--;
Col. 14, line 36, delete "be";
Col. 14, line 59, change "satisfies" to --satisfy--.

Col. 17, line 4, delete "has";
Col. 17, line 7, delete "has";
Col. 17, line 11, delete "with".

Col. 18, line 29, delete "the" (first occurrence);
Col. 18, line 34, change "blame" to --blade--;
Col. 18, line 42, change "represent&d" to --represented--.

Col. 21, line 46, change "roller-as sot" to --roller as set--.

Col. 27, line 19, change "systems" to --styrene--.
Col. 27, line 29, change "foam-polyurethane" to --foam polyurethane--.

UNITED STATES PATENT AND TRADEMARK OFFICE

CERTIFICATE OF CORRECTION

PATENT NO. : 5,489,974

DATED : February 6, 1996

INVENTOR(S) : Hideki KAMAJI, et al.

It is certified that error appears in the above-indentified patent and that said Letters Patent is hereby corrected as shown below:

Col. 28, line 54, change "of-an" to --of an--.

Signed and Sealed this

Third Day of September, 1996

*Attest:*

Bruce Lehman

BRUCE LEHMAN

*Attesting Officer*

*Commissioner of Patents and Trademarks*